US011717708B2

(12) United States Patent
Rogge

(10) Patent No.: US 11,717,708 B2
(45) Date of Patent: Aug. 8, 2023

(54) ABSEILING DEVICE

(71) Applicant: MITTELMANN SICHERHEITSTECHNIK GMBH & CO KG, Velbert (DE)

(72) Inventor: Guido Rogge, Velbert (DE)

(73) Assignee: MITTELMANN SICHERHEITSTECHNIK GMBH & CO KG, Velbert (DE)

( * ) Notice: Subject to any disclaimer, the term of this patent is extended or adjusted under 35 U.S.C. 154(b) by 1550 days.

(21) Appl. No.: 15/555,513

(22) PCT Filed: Mar. 3, 2016

(86) PCT No.: PCT/DE2016/100099
§ 371 (c)(1),
(2) Date: Jan. 14, 2018

(87) PCT Pub. No.: WO2016/138894
PCT Pub. Date: Sep. 9, 2016

(65) Prior Publication Data

US 2018/0296861 A1 Oct. 18, 2018

(30) Foreign Application Priority Data

Mar. 5, 2015 (DE) ..... 202015001685.5
Oct. 22, 2015 (DE) ..... 202015007330.1

(51) Int. Cl.
*A62B 1/00* (2006.01)
*A62B 1/10* (2006.01)
(Continued)

(52) U.S. Cl.
CPC ..... *A62B 1/10* (2013.01); *A62B 1/08* (2013.01); *B66D 1/02* (2013.01); *B66D 1/36* (2013.01);
(Continued)

(58) Field of Classification Search
CPC .... A62B 1/08; A62B 1/10; B66D 1/02; B66D 1/14; B66D 1/36; B66D 1/54; B66D 1/58;
(Continued)

(56) References Cited

U.S. PATENT DOCUMENTS 4,103,872 A * 8/1978 Hirasuka ..... B66D 1/58 254/362
4,317,282 A 3/1982 Pace
(Continued)

FOREIGN PATENT DOCUMENTS

DE 2305452 8/1974
DE 10210969 10/2003
(Continued)

OTHER PUBLICATIONS

DIN EN 341:2011.
(Continued)

*Primary Examiner* — Emmanuel M Marcelo
(74) *Attorney, Agent, or Firm* — Leydig, Voit & Mayer Ltd.

(57) ABSTRACT

The invention relates to an abseiling device comprising a bidirectionally rotatable guiding arrangement (25) for guiding a pulling means (26); further comprising a braking mechanism (30) that is coupled to the guiding arrangement (25); a driving means (34; 35) can be connected to the guiding arrangement (25) so as to actuate the guiding arrangement (25). In order to create an abseiling device that prevents an individual from being injured or parts of the abseiling device from being damaged during rescue operations in particular of people, a mechanical torque limiter (33) decouples the driving means (34; 35) and the guiding arrangement (25) or the pulling means (26) when the torque exceeds a certain threshold value.

21 Claims, 12 Drawing Sheets

(51) Int. Cl.

| | |
|---|---|
| ***B66D 1/54*** | (2006.01) |
| ***A62B 1/08*** | (2006.01) |
| ***B66D 1/02*** | (2006.01) |
| ***B66D 1/36*** | (2006.01) |
| ***B66D 1/58*** | (2006.01) |
| ***B66D 5/04*** | (2006.01) |

(52) U.S. Cl.
CPC ..... *B66D 1/54* (2013.01); *B66D 1/58* (2013.01); *B66D 5/04* (2013.01); *B66D 2700/0125* (2013.01); *B66D 2700/0191* (2013.01)

(58) Field of Classification Search
CPC ..... B66D 5/04; B66D 2700/0125; B66D 2700/0191
See application file for complete search history.

(56) References Cited

U.S. PATENT DOCUMENTS

| | | | | |
|---|---|---|---|---|
| 4,367,863 | A * | 1/1983 | Dulondel | A62B 1/10 188/290 |
| 5,090,507 | A | 2/1992 | Olson | |
| 5,150,768 | A | 9/1992 | Olson | |
| 5,217,084 | A | 6/1993 | Olson | |
| 6,223,868 | B1 * | 5/2001 | Wullimann | A62B 1/10 188/65.1 |
| 7,270,312 | B1 * | 9/2007 | Phipps | B66D 1/22 254/297 |
| 8,893,854 | B2 * | 11/2014 | Casebolt | B65H 75/48 182/235 |
| 10,688,323 | B2 * | 6/2020 | Wolner | A62B 1/10 |
| 2004/0168855 | A1 | 9/2004 | Leon | |
| 2007/0151802 | A1 | 7/2007 | Tillitski et al. | |
| 2007/0194290 | A1 | 8/2007 | Fofonoff et al. | |
| 2008/0128221 | A1 * | 6/2008 | Rogge | A62B 1/10 188/65.1 |
| 2008/0142298 | A1 | 6/2008 | Blasek | |
| 2010/0282541 | A1 * | 11/2010 | Renton | A62B 1/18 182/234 |
| 2012/0048651 | A1 * | 3/2012 | Rinklake | A62B 1/10 192/103 B |
| 2012/0240707 | A1 * | 9/2012 | Pachov | B66D 5/30 74/425 |
| 2013/0240811 | A1 | 9/2013 | Wilson | |
| 2016/0311667 | A1 * | 10/2016 | Huang | B66D 1/58 |
| 2017/0058998 | A1 * | 3/2017 | Bujold | B66D 1/14 |
| 2022/0363523 | A1 * | 11/2022 | Marshall, III | B66D 3/006 |

FOREIGN PATENT DOCUMENTS

| | | | |
|---|---|---|---|
| DE | 20318516 | | 8/2004 |
| DE | 202007013135 | U1 | 2/2008 |
| EP | 0539759 | A1 | 5/1993 |
| EP | 0624387 | | 11/1994 |
| EP | 0997606 | | 5/2000 |
| EP | 1608838 | B1 | 10/2006 |
| EP | 1994960 | A1 | 11/2008 |
| WO | WO 2009 036747 | A2 | 3/2009 |
| WO | WO2010135847 | | 12/2020 |

OTHER PUBLICATIONS

DIN EN 1496:2006.
Catalogue of Skylotec GmbH of Sep. 2013 (pp. 200-207).
User manual Milan Power 2.0 of Jun. 12, 2014.
User manual Panasonic model nr. EY7460/EY7960 of Dec. 2, 2013 (front page + pp. 17-28).
Price list of Skylotec of 2014 (pp. 2, 3, 45, 46).
Written opinion PCT/DE2016/100099.
Preliminary examination report PCT/DE2016/100099.
Jin Yi, Introduction to the application of friction limit torque clutch, Taiyuan Research Institute of Coal Research Institute, Apr. 2007, pp. 1-4, Jiangsu, China.
Photo of prior use by Skylotec.
Aka, Zumbo et al., Descender, pp. 1-2, https://de.wikipedia.org/wiki/Abseilger%25C3%25A4t?oldid=148635862.
DIN EN 341, Personal fall protection equipment—descenders for rescue, Jun. 2011, pp. 1-27, European Committee for Standardization, Brussels, Belgium.
Unidrive, Original Operating Instructions, Dec. 2006, pp. 1-42, Mittelmann Sicherheitstechnik GmbH Co. KG, Velbert, Germany.
Risk analysis UNIDRIVE.
European Community sample security report UNIDRIVE.
Examination report PB 15-193.
Essential health and safety requirements for the design and construction of machines, Jun. 2006, pp. 1-30, Official Journal of the European Union.

* cited by examiner

ABSEILING DEVICE

The invention relates to an abseiling device which comprises a bidirectionally rotatable guiding arrangement for guiding a pulling means, and a braking mechanism that is coupled with the guide roller, with a drive means being connectable to the guiding arrangement for actuating the guiding arrangement.

DE 102 10 969 A1 describes an abseiling device with a bidirectionally rotatable guiding arrangement braking mechanism for guiding a pulling means and a braking device that is embodied as a centrifugal brake and is coupled with the guiding arrangement, wherein a drive means that comprises a first lever element, a second lever element, and a grip element can be connected to the guiding arrangement in order to manually actuate the guiding arrangement. A drawback of the described abseiling device is that only manual actuation is possible—by means of a hand crank, for example—lest the abseiling person be endangered by excessive forces.

Abseiling devices that are known from the prior art and can be used for rescue, particularly including as rescue lifting devices, must satisfy the requirements inter alia of Eurocodes DIN EN 341: 2011 ("Personal fall protection equipment—Abseiling devices for rescue") and DIN EN 1496: 2006 ("Personal fall protection equipment—rescue lifting devices"), which defines the maximum permissible abseiling speed, for example.

WO 2010/135847 A1 describes a hoisting winch with a bidirectionally rotatable guiding arrangement for guiding a pulling means, wherein a drive means embodied as a motor is connected to the guiding arrangement for actuating the guiding arrangement, wherein the drive means transfers a rotational movement to a drive axle by means of a reduction gear, wherein the drive axle is connected via gear wheels to a coupling mechanism, wherein the coupling mechanism comprises an annular block running around the drive axle, which block comprises several pins that are pretensioned by springs in the axial direction that can be introduced into recesses of the guiding arrangement. The coupling mechanism limits the transmission of a mechanical torque, with the drive means and the guiding arrangement being decoupled when a torque threshold value is exceeded.

US 2004/0168855 A1 describes a device for evacuating a person from a building, comprising a braking device that is coupled with a guiding arrangement, which braking device can be embodied as an impeller brake or also as an eddy-current brake, with the guiding arrangement being rotatably mounted on a first axle and connected via gear wheels to the axle of the impeller brake. One drawback of the described abseiling device is that the user can only move from a higher to a lower position and cannot be lifted by an appropriate drive means from a lower position to a higher position.

EP 0 539 759 A1 describes a hoist winch with a bidirectionally rotatable guiding arrangement for guiding a pulling means and a braking device coupled with the guiding arrangement, which braking device is formed by pawls rotatably connected to the end wall of the guiding arrangement, which is embodied as a drum, and a force-applying member, wherein a drive means can be connected to the guiding arrangement for actuating the guiding arrangement and wherein engaging coupling plates and rotatable plates form a mechanical torque limiter that decouples the drive means and the guiding arrangement and/or pulling means in the manner of a slip clutch when a torque threshold value is exceeded. One drawback of the described hoisting winch is that, unlike an abseiling device, it is not suitable for descending or ascending again alone. Instead, a second person is always required to actuate the winch for lowering. What is more, steady abseiling at a continuous abseiling speed is not possible due to the braking device, which serves rather as a fall arrester. In reality, the described braking device has the effect of an emergency brake which, without actuation of the drive means embodied as a hand crank or also as a motor, prevents further descent of the person from a higher to a lower point. The known hoisting winch therefore cannot be used as an abseiling device that would make it possible for a person to descend or evacuate alone without the aid of a helper.

DE 20 2007 013 135 U1 describes an abseiling device in which a pulling means is guided over a guiding arrangement that is embodied as a guide roller, with a braking device for braking the guiding arrangement being associated with the guiding arrangement that is embodied as a centrifugal brake. The braking device and the guiding arrangement are arranged on two mutually parallel shafts that are in geared engagement with one another via corresponding peripheral toothing and thus define a transmission or reduction.

DE 203 18 516 U1 describes an abseiling device in which the guiding arrangement for guiding a pulling means and the braking device for braking the guiding arrangement are arranged on the same axle, with a guide means that is embodied as a rope being guided over a conically shaped drum portion and encloses same with several windings.

EP 0 624 387 B1 describes a device for lowering or raising a load in which a guiding arrangement for guiding a pulling means is wrapped around multiple times by the pulling means, which is embodied as a rope, with the guiding arrangement being embodied as a sleeve that can be rotated on an axle and is rotated about the axle in order to lift a load with the rope, whereas the rope is rotated on the sleeve in order to lower the load, and with the braking device being formed by the mutually wedging pulling means, which is hindered from giving way in the vicinity of the sleeve.

In practice, abseiling devices are used as a rescue lifting device in order to rescue people who have fallen, for example. These require not only that a person be able to be lowered at a limited speed on a pulling means such as a rope, but also—for example, in order to unlock a locking mechanism or in order to rescue someone from a crevasse—that a drive means, such as a handwheel, for example, be provided for the pulling means, which is guided on a guiding arrangement, such as a guide roller, with which the load can be raised counter to the lowering direction. One problem with this, however, is that the torque introduced by the handwheel into the gear mechanism or into a locking mechanism of the abseiling device can already result in damage to those parts.

It is the object of the invention to provide an abseiling device that is simple to operate and, particularly during the rescuing of people, prevents injury to the person or damage to parts of the abseiling device.

This object is achieved according to the invention by a device with the features of an independent claim.

According to one aspect of the invention, an abseiling device is provided which comprises a bidirectionally rotatable guiding arrangement for guiding a pulling means, and a braking mechanism that is coupled with the guide arrangement, with a drive means being connectable to the guiding arrangement for actuating the guiding arrangement. A provision is further made that a mechanical torque limiter decouples the drive means and the pulling means—or the guiding arrangement guiding the pulling means—when a torque threshold value is exceeded. Advantageously, this ensures that, as a result, the torque that acts on the pulling means does not exceed a defined upper limit. In this way, the abseiling device can be used advantageously for lifting people, particularly injured people, without the risk of injuring the person to be lifted as a result of the drive means developing too much torque. Another advantage is that the forces that are introduced into the abseiling device are limited at least in the part of the abseiling device that is downstream from the mechanical torque limiter, so that particularly moving parts that are mechanically engaged, such as gear wheels, locking devices, or the like, are protected.

In particular, the abseiling device according to the invention makes it possible to directly or indirectly connect external drive means to the guiding arrangement whose torque often exceeds the torque required to rescue a person and which are generally not approved for the actuation of the guiding arrangement due to the associated risk of injury. This enables the abseiling device to be coupled with an external drive means without the risk of injuries to the person or load to be lifted, so that force other than manual force can be transferred to the pulling means. The abseiling device thus becomes a versatile rescue lifting device.

In any case, the mechanical torque limiter preferably decouples the drive means and the guiding arrangement guiding the pulling means when a torque threshold value is exceeded.

Expediently, the mechanical torque limiter is arranged between the drive means and the guiding arrangement, so that at least the guiding arrangement and the pulling means guided by the guiding arrangement are protected from excessive torques. In this way, it is ensured that, when a torque is introduced by the drive means, the pulling means and persons who may be hanging onto it are exposed to no more than the threshold value of the torque of the drive means.

Expediently, the mechanical torque limiter is part of the guiding arrangement, so that the torque limiter part decouples the guiding arrangement from the drive means. This can be achieved, for example, by associating an external sleeve part of the torque limiter to the guiding arrangement, whereas an internal plug-in part of the torque limiter is associated with a shaft that is associated with the guiding arrangement. Alternatively, the guiding arrangement itself can be embodied as a mechanical torque limiter, particularly by decoupling the force transmission to the pulling means when a torque threshold value is exceeded.

Alternatively it is possible that the mechanical torque limiter is part of the drive means. In that case, the drive means can be associated with the sleeve part of the torque limiter, for example, and a shaft projecting from the drive means can be associated with the plug-in part of the torque limiter. Alternatively, however, it is also possible that the sleeve part is associated with the shaft and the plug-in part with the drive means. A provision can be advantageously made here that, in configuring the drive means as a manually operable handwheel, it nevertheless contains an extension for another, for example motor-driven drive means, so that the motor-driven and/or the manual drive means can be actuated as desired.

According to a preferred embodiment, a provision is made that the mechanical torque limiter is arranged on a shaft having the braking device. Advantageously, this ensures that the mechanical torque limiter is adapted to a shaft driving the braking device while ensuring at the same time that the braking device does not brake the drive means when the drive means is actuated.

Advantageously, it is also possible that the mechanical torque limiter is arranged on a shaft having the guiding arrangement, so that the threshold value of the mechanical torque limiter is coordinated with the guiding arrangement. It will readily be understood that the guiding arrangement and the braking device can also be connected to the same shaft.

Expediently, the shaft is positively lockable in one direction of rotation by a locking mechanism, whereas it is released in the opposite direction of rotation. As a result, the shaft—which can be both the shaft having the braking device and the shaft having the guiding arrangement, if they are not already provided on a common shaft—can only rotate in one direction, whereas the other direction of rotation is positively locked. The particular advantage of the locking mechanism is that the guiding arrangement can only be actuated in one direction in order to move the pulling means, thereby averting the risk of the load to be lifted sliding down if the drive means suddenly detaches.

The positive locking can be expediently switched to both directions of rotation, thus enabling one direction of rotation to be locked as desired while the opposite direction of rotation is released, and vice versa. It is possible to additionally provide for the releasing of both directions of rotation and/or the locking of both directions of rotation as well.

The locking is expediently achieved by means of a ratchet or a spring-loaded bolt that causes a locking member to engage with toothing that rotates with the associated shaft. The ratchet can also be mounted as an external part onto the locking shaft, but it is preferably integrated permanently into the abseiling device.

It is especially expedient if the locking mechanism comprises a switch that selectively causes one of two pawls to engage for positive locking and simultaneously disengages the other of the two pawls, so that exactly one direction of rotation is always locked and the other direction of rotation is released.

It is possible that the guiding arrangement and the braking device are arranged on the same shaft, so that the rotational movement of the guiding arrangement simultaneously triggers the braking device. A provision is preferably made, however, that the guiding arrangement is coupled with the braking device by means of a gear mechanism, so that the shaft carrying the braking device is reduced in relation to the shaft carrying the guiding arrangement and thus has a higher rotational speed. In this way, the braking device can be advantageously fine-tuned to preset abseiling speeds of the guiding arrangement, so that, once a certain speed is reached, the abseiling speed of the guiding arrangement is slowed down to the point that no further acceleration occurs.

Expediently, the gear mechanism has a first and a second shaft, with the braking device being arranged on the first shaft and the guiding arrangement being arranged on the second shaft. Gear wheels and/or toothings associated with the first shaft and the second shaft interlock to create a gear mechanism. It is also possible, however, for an idler wheel to engage between the first shaft and the second shaft.

Preferably, a first gear wheel of the gear mechanism is supported on a common first shaft with the braking device, and a second gear wheel of the gear mechanism is supported in a torque-proof manner on a common second shaft with the guiding arrangement, with the first gear wheel engaging with the second gear wheel. Advantageously, this ensures that, when either the first shaft or the second shaft is locked, the respective other shaft is also locked by virtue of the fact that the first gear wheel and the second gear wheel mutually block the first shaft and the second shaft. In this way, the entire gear mechanism can be blocked using a single locking mechanism. Furthermore, according to an advantageous embodiment, the mechanical torque limiter is then selectively connected to a second shaft having the guiding arrangement and to a first shaft having the braking device. The gear mechanism can have two mutually parallel shafts, but it is also possible for the gear wheels to be embodied as bevel gears, so that the shafts are not parallel. In the case of a gear mechanism that is embodied as a planetary gear, the two shafts can also be arranged coaxially. Preferably, at least one of the two shafts can be embodied as a hollow shaft.

The first gear wheel is expediently embodied as a small gear wheel and the second gear wheel as a large gear wheel in order to produce a transmission. The gear mechanism is therefore expediently embodied as transmission gearing and accommodated in a housing. The small gear wheel can also be embodied as a toothing provided on the shaft that does not project radially in relation to the shaft, thus enabling the desired transmission to be achieved with small dimensions.

Expediently the housing comprises a first housing part and a second housing part, with the first housing part and the second housing part being screwed together. In this way, various parts of the gear mechanism can be arranged in different housing parts.

Preferably, the mechanical torque limiter comprises two parts that are inserted into one another—a plug-in part and a sleeve—that mutually generate slippage when a threshold torque value is exceeded. This ensures that the preset threshold value is not exceeded when a force is transmitted via the mechanical torque limiter, so that no more than the threshold torque value is transferred. The sleeve can be embodied so as to be broken or divided, thus enabling the sleeve to spread open and thus decouple radially from the plug-in part. Preferably, the sleeve has a notch in its expediently approximately cone-shaped shell that can also extend over the entire length of the shell.

According to a first advantageous embodiment, a provision is made that the guiding arrangement guides the pulling means in a slip-proof way in the manner of a roller.

Alternatively, a provision is made that the mechanical torque limiter comprises two halves of the guiding arrangement that jointly guide the pulling means and, when the torque threshold value is exceeded, permit mutual slippage. Advantageously, this ensures that the slippage of the pulling means in relation to the two halves of the guiding arrangement ceases when the torque acting on the guiding arrangement exceeds a threshold value, so that the slippage exceeds the torque overage, so that a maximum stress for a load to be lifted, particularly an injured person, is not exceeded.

According to a preferred embodiment, a provision is made that the drive means is a handwheel for manually operating the abseiling device. The mechanical torque limiter ensures that the handwheel does not exceed the maximum torque value that is set as a threshold value, so that neither a gear mechanism nor the positive-locking engagement means of a locking mechanism is damaged or even sheared off. An injury to the person to be lifted is also advantageously avoided.

According to another embodiment, a provision is made that the drive means is a motorized drive, for example an impact wrench, a pneumatic drilling apparatus, a hydraulic turbine, a combustion engine, or a cordless screwdriver, or a shaft or kinematics driven by same. Such motorized drives have a very high level of torque that might injure an ascending person if introduced without restriction into the abseiling device. Here, the mechanical torque limiter has the advantageous effect of preventing such an injury.

The drive means can be mounted as an external drive means for example onto an internal hexagonal recess of the abseiling device or of a shaft or of an extension of the abseiling device, thereby transmitting the torque directly or indirectly to the guiding arrangement and/or the pulling means. Such an internal hexagonal recess can be provided in the proximity of a handwheel of the abseiling device, for example, so that the handwheel and/or an external drive means simultaneously transfer the force to the shaft to which the handwheel is connected.

Alternatively, it is also possible to couple a motorized drive securely to the abseiling device, for example by mounting it on the abseiling device or by providing an integrated motor in order to make the required power available as needed. For example, the motorized drive can be embodied as an electric motor, in which case the rechargeable battery required for the drive is not integrated into the abseiling device but rather connected thereto externally. In this case, it is then advantageously only necessary to electrically connect a rechargeable battery externally.

According to a preferred embodiment, a provision is made that the drive means contains an integrated torque limiter, with the mechanical torque limiter of the abseiling device having a lower threshold value than the torque limiter integrated into the drive means. As a result, drive means with integrated torque limiter can also be used, although those are frequently quite imprecise and are therefore not inherently suitable for driving abseiling devices used by people for ascending.

Expediently the drive means is part of the abseiling device and is coupled securely with a shaft of the abseiling device and/or with a housing of the abseiling device, wherein the power supply can be provided internally as well as externally.

According to a favorable embodiment, the drive means can also be connected to the abseiling device outside of a shaft carrying the braking device, for example to a separate tool fitting. This is then preferably coupled with the guiding arrangement by means of a separate gear mechanism.

Expediently, the braking device is embodied as a centrifugal brake. Instead of a centrifugal brake, it is possible to provide an electromagnetic or other brake that brakes as a function of a speed of the guiding arrangement or of a shaft detected by sensor.

Expediently, the guiding arrangement is embodied as a rotatably mounted guide roller or as a pulley. The pulling means that is embodied as a rope can be placed over the pulley, where it is held against slipping, and a person can be lowered over both ends of the rope under the effect of their load and also be raised against their load by actuating a drive means.

The threshold torque value at which the mechanical torque limiter performs decoupling is expediently coordinated with a load lifted by the abseiling device and is expediently between 2 Nm and 100 Nm, preferably between 5 Nm and 50 Nm, especially preferably between 7 Nm and 20 Nm, and very especially preferably between 8 Nm and 15 Nm. When using external drive means that are held manually, threshold values below 15 Nm, particularly in the range from 9 Nm to 12 Nm, generally around 10 Nm, are worthy of consideration.

According to one aspect, an abseiling device is provided which comprises a bidirectionally rotatable guiding arrangement for guiding a pulling means, and a braking mechanism that is coupled with the guide arrangement, with a drive means being connectable to the guiding arrangement for actuating the guiding arrangement. A provision is also made here that the drive means can be received in a holding fixture and that the holding fixture can be fixed on a holding component of the abseiling device. Particularly, the resulting abseiling device receives a motorized drive, such as an impact wrench, pneumatic drilling apparatus, hydraulic turbine, combustion engine, or cordless screwdriver, for example, and secures them against twisting when the drive is actuated. It is thus possible to fasten the drive means to the abseiling device, with the holding fixture absorbing the torque of the drive means, so that a rotational movement delivered at an output shaft of the drive means can be introduced indirectly or directly into the guiding arrangement. Attaching the holding fixture to the holding component of the abseiling device enables forces to be introduced into the abseiling device in an especially simple manner. The user no longer needs to hold the drive means in his hand, and because he is usually hanging on a rope, the rope is also not moved when the forces are absorbed, which results in a more stable position of the user. Since the drive means is received in a holding fixture, it is protected particularly from falling down, thereby substantially reducing the danger of the drive means plummeting to the ground. The holding fixture supports the drive means such that the output shaft of the drive means can be inserted into a corresponding drive nut of the abseiling device, so that the supported drive means can be operated with one hand, even with one finger, since no hand is required any longer in order to steady the drive means against twisting. At the same time, the holding fixture provides a possibility for temporarily or permanently coupling the drive means with the abseiling device, so that the drive means van also be reliably laid down by a user during work. Likewise, the holding fixture ensures that the drive means that is connected to the holding fixture does not twist while the pulling means is being lowered, so that the user is protected from injuries resulting from a rotational movement or jerking of the drive means.

It is expedient for the holding fixture to have a receptacle for a grip of the drive means that can be locked to fix the drive means in place. This receptacle is expediently disposed in a peripheral region of the grip that is tapered in relation to adjacent regions, thus preventing slippage from the receptacle. As a result, while it is necessary to open and relock each time the drive means is removed or inserted, this provides for a high level of safety against falls. Ideally, the power supply of the drive means, which is often arranged in the proximity of the grip, can be changed out while the receptacle continues to hold the drive means as a whole in place. It is possible to provide additional receptacles or locking mechanisms in order to additionally lock the drive means in place, but only a single lockable receptacle is expediently provided for the sake of the often called-for one-handed operation.

According to one simple embodiment, the receptacle can contain two braces that are parallel or form a V-shape that are able to encompass the grip on both sides and thus constitute the anti-rotation lock for the drive means. In addition, a safety pin can be passed through the two braces that simultaneously locks the drive means to the two braces. However, a provision is preferably made that the receptacle is embodied as a reclosable ring in the manner of a reclosable cable clip. This enables different-sized grips for drive means to be coupled with the abseiling device, and the reclosable ring enables frequent opening and closing and, in particular, does not contain any parts that could fall during operation. The locking lever of the unlockable cable clip can be unlocked with one hand, for example using a thumb, while the other hand holds the drive means and can then pull it out of the receptacle, thus resulting in an especially favorable and simple safeguard against falling when removing the drive means. Alternatively, the reclosable ring can also have a different design, for example in the manner of a belt with various punched holes or with a belt material through which an awl can be passed as desired. Other locking mechanisms, such as those using pairs of magnets or hook-and-loop strips, can also be considered.

The holding fixture can be expediently fixed non-rotatably to the abseiling device, so that the torques introduced into the holding fixture as a result of the actuation of the drive means do not result in a relative movement between holding fixture and the rest of the abseiling device.

According to a preferred embodiment, a provision is made that the holding fixture has a portion whose length can be adjusted, so that drive means of different sizes and particularly of different lengths—including those with chucks or drive shafts of different lengths—can be combined with the abseiling device. For this purpose, the length-adjustable portion can have a telescopic design, for example; however, a provision is especially preferably made that the length-adjustable portion is provided in a middle region between the receptacle and a coupling portion with which the holding fixture is connected to the holding component, and that the length of the length-adjustable portion can be set. For example, two braces that are coupled together can be interconnected by means of a hole profile, in which case the different punched holes are associated with different drive means. Since the make of the drive means is generally not changed during use, an adjustment is made only quite rarely.

It is possible for the holding fixture to support interlinks arranged between an output shaft of the drive means and the input shaft of the abseiling device. An example of such interlinks are coaxial shaft sections that are mutually carried along up to a certain load; another are non-return devices in the manner of a ratchet, switchable freewheels, extensions, gear mechanisms, or other parts in which a torque transmitted from the drive means has to be supported. It will readily be understood that the holding fixture can also have several areas and, in particular, can also include parts of the housing of the abseiling device.

The holding fixture is expediently arranged parallel to an axle of the guiding arrangement, so that, in particular, the drive shaft of the drive means can also be aligned parallel to the axle of the guiding arrangement, so that the torque outputted from the drive shaft can be fed either to the axle carrying the guiding arrangement or to an axle that is parallel thereto and coupled with the axle of the guiding arrangement via a gear mechanism. Alternatively, it is possible, using a bevel gear or the like, to provide the input shaft of the abseiling device so as to be inclined to the axle of the guiding arrangement, in which case the holding fixture is also embodied accordingly. For instance, in a bevel gear arrangement the input shaft of the abseiling device can point substantially upward, which makes it necessary to outfit the drive means with a drive shaft that points downward. For example, this position of the drive means is supported by the holding fixture, which is embodied in the manner of a pistol holster and connected to one side of the housing of the abseiling device, with the tip of the holster being flush with the input shaft. This especially compact and small-sized arrangement makes it possible, in particular, to provide another handwheel as an additional drive means.

The holding component is expediently selected from the group comprising a housing or a housing part of the abseiling device, a ring, carabiner hooks, clevises or eyes connected to the abseiling device, and a chuck provided on or connected to the abseiling device, or comparable components. If the holding fixture is supported on a housing or housing part of the abseiling device, it is expedient if the holding fixture can be connected appropriately to the housing part, for example through the provision of a recess or chuck. It is therefore expedient for the holding fixture to be connected to a clevis or the like that is connected to the abseiling device, in which case a safety pin is expediently provided for axial locking that passes through the holding fixture as desired on one or both sides of the clevis. The holding fixture is expediently embodied such that rotation about its own axle passing through the clevis is impeded, so that the holding fixture always points in the same direction, independently of whether or not a drive means is connected.

Preferably, a mechanical torque limiter decouples the drive means and the pulling means—or the guiding arrangement guiding the pulling means—when a torque threshold value is exceeded. The mechanical torque limiter can be provided within the abseiling device; however, it is expediently provided on an attachment for the motorized drive means. According to a first preferred embodiment, the mechanical torque limiter is integrated into a handwheel that is associated with an input shaft of the abseiling device. Alternatively, the mechanical torque limiter can be provided at each point between output shaft of the motorized drive means and pulling means, and instead of an integrally formed design with the handwheel, an arrangement as a separate interlink between a drive shaft and an output shaft can also be considered. The mechanical torque limiter is expediently set to a threshold torque value that is coordinated with the entire system of the abseiling device in order to prevent injuries to a person to be rescued. The integrally formed design ensures that, even when over-dimensioned motorized drive means are used, only the maximum permissible force for the abseiling device is always transmitted.

According to one aspect, a lifting device is provided which comprises a bidirectionally rotatable guiding arrangement for guiding a pulling means, with a drive means being connectable to the guiding arrangement for actuating the guiding arrangement. A provision is also made here that a mechanical torque limiter decouples the drive means and the pulling means—or the guiding arrangement guiding the pulling means—when a torque threshold value is exceeded. Advantageously, this ensures that, as a result, the torque that acts on the pulling means does not exceed a defined upper limit. In this way, the lifting device can be used advantageously for lifting people, particularly injured people, without the risk of injuring the person to be lifted as a result of the drive means developing too much torque. Another advantage is that the forces that are introduced into the lifting device are limited at least in the part of the lifting device that is downstream from the mechanical torque limiter, so that particularly moving parts that are mechanically engaged, such as gear wheels, locking devices, or the like, are protected. In any case, the mechanical torque limiter preferably decouples the drive means and the guiding arrangement guiding the pulling means when a torque threshold value is exceeded.

In particular, the lifting device according to the invention makes it possible to directly or indirectly connect external drive means to the guiding arrangement whose torque often exceeds the torque required to rescue a person and which are generally not approved for the actuation of the guiding arrangement due to the associated risk of injury. This enables the lifting device to be coupled with an external drive means without the risk of injuries to the person or load to be lifted, so that force other than manual force can be transferred to the pulling means.

Preferably, the lifting device has one or more of the features described above for the abseiling device, such as a braking device, etc. In an especially favorable embodiment, the lifting device has an integrated abseiling device.

According to one aspect, the use of a mechanical torque limiter is specified as an overload protection in an abseiling device or lifting device, which has a bidirectionally rotatable guiding arrangement for guiding a pulling means, and a braking mechanism that is coupled with the guide arrangement, with a drive means being connectable to the guiding arrangement for actuating the guiding arrangement.

Additional advantages, features and details of the invention follow from the following description of a preferred exemplary embodiment as well as from the enclosed claims.

The invention is explained in further detail below with reference to the enclosed drawings on the basis of preferred exemplary embodiments.

Figure 1:
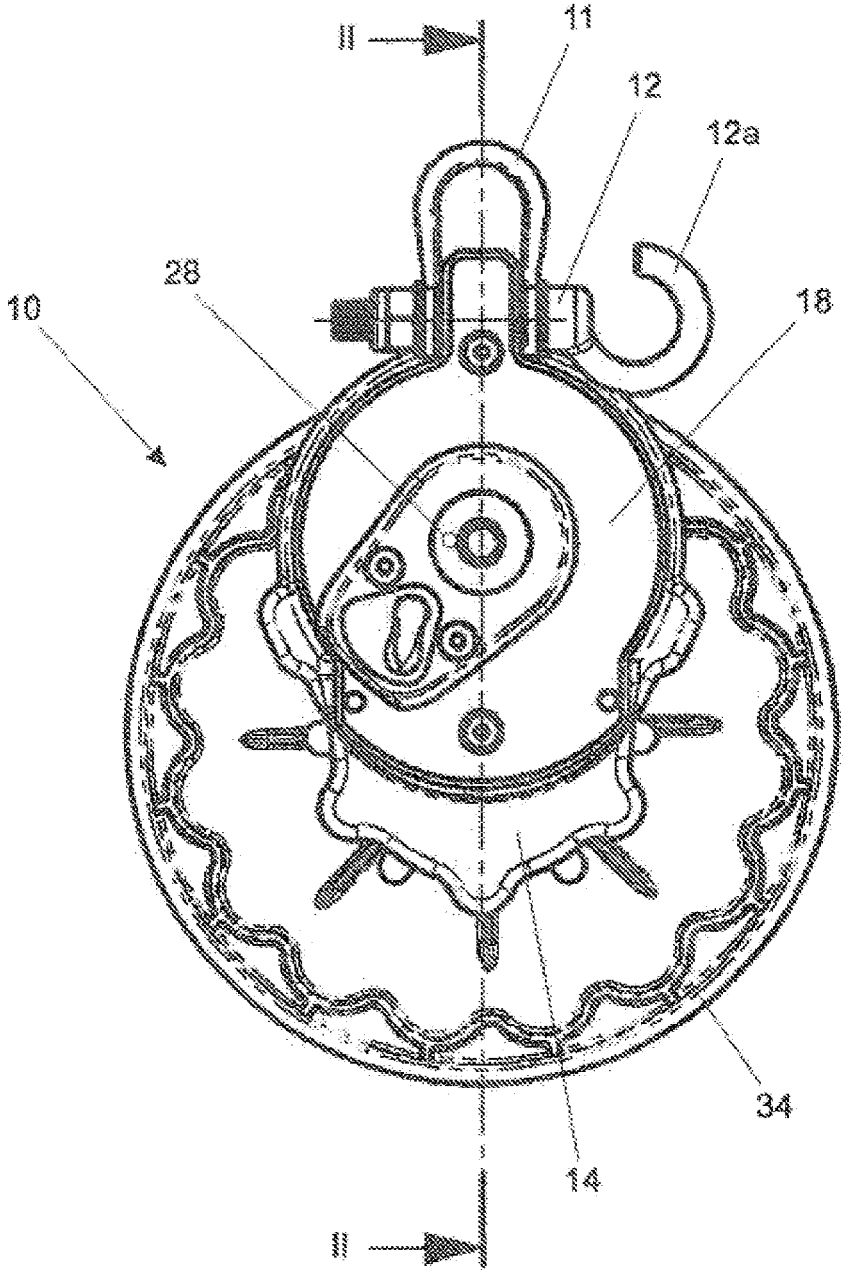
FIG. 1 shows a front-side view of a first exemplary embodiment of an abseiling device according to the invention.
Figure 2:
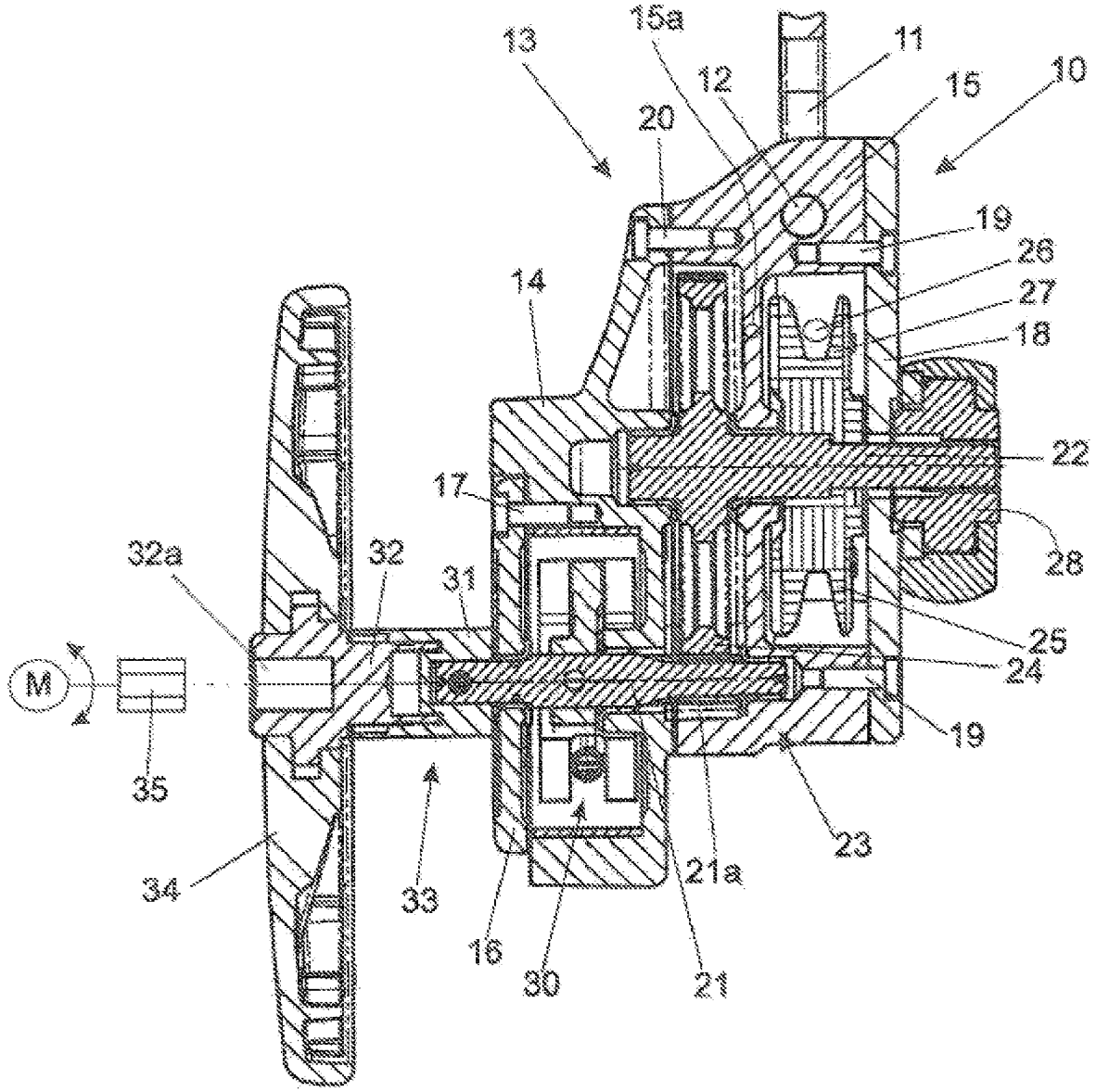
FIG. 2 shows a section along line II-II through the abseiling device from FIG. 1.

FIGS. 1 and 2 show an abseiling device 10, which is an abseiling device with gear mechanism in the present case, as will be explained in further detail below. It can be seen that the abseiling device 10 can be hung by means of a carabiner 11, which is connected to a pin 12. The end 12*a* of the pin 12 is embodied as a hook. The abseiling device 10 comprises a housing 13 that is composed of a first housing part 14, the so-called brake housing, and a second housing part 15, the so-called pulley housing, which are interconnected. The brake housing 14 is closed by a brake housing lid 16 using three screws 17, one of which is illustrated in FIG. 2; the pulley housing 15 is closed by a pulley housing lid 18, which is connected to the pulley housing 15 by two screws 19. Three screws, one screw 20 of which is depicted in FIG. 2, connects the pulley housing 15 to the brake housing 14.

A first shaft 21 and a second shaft 22 are respectively arranged in the housing 13 and coupled together via a gear mechanism 23. The first shaft projects axially over the brake housing lid 16 and is supported peripherally in the brake housing lid 16 and in the pulley housing 15. The first shaft 21 has a peripherally toothed portion 21*a* that engages with a gear wheel 24, which is integrally formed with the second shaft 22, and is in geared engagement in order to form the gear mechanism 23. The ratio of the circumferences of the toothing of the toothed portion 21*a* forming a first gear wheel 24 and of the gear wheel 24 is approximately 1 to 9, so that reduction gearing is created in which the second shaft 22 rotates once when the first shaft rotates nine times.

The second shaft 22 with the gear wheel 24 is supported at one end in the brake housing 14 and at the other end in the pulley housing lid 18. Seated on the second shaft 22 is a guiding arrangement embodied as a pulley 25 for a pulling means embodied as a rope 26, which is guided in a continuous, V-shaped profile 27 of the pulley 25. An extension of the second shaft 22 projects over the pulley housing lid 18 and into a locking mechanism that is embodied as a ratchet 28, which locking mechanism can be switched so as to lock the rotational movement of the second shaft 22 and hence also of the first shaft 21 or of the gear mechanism 23.

It can be seen that the second shaft 22 is supported centrally in an opening of a partition 15*a* of the pulley housing 15 that simultaneously separates the pulley 25 spatially from the second gear wheel 24. As a result, the pulley 25 is nearly arranged in its own chamber, which is open toward the bottom in FIG. 1, so that the two ends of the rope 26 that are guided continuously in the profile 27 point downward out of the housing 13. In this way, the area of the second gear wheel 24, including the gear engagement with the first gear wheel 21*a*, is advantageously encapsulated and protected from contaminants.

A centrifugal brake 30 that is embodied as a brake arrangement is connected to the first shaft 21 which, when a defined rotational speed of the first shaft 21 is exceeded, causes a braking force and reduces the rotational speed of the gear mechanism 23 overall.

A sleeve part 31 of a mechanical torque limiter 33 is connected to the portion of the first shaft 21 projecting over the brake housing lid 16 that is connected in a rotationally fixed manner to the first shaft 21, for example by means of a hexagonal head of the first shaft 21. A plug-in part 32 of the torque limiter 33 is plugged into the sleeve part 31, and the threshold value up to which torques that are introduced into the plug-in part 32 are transferred to the sleeve part 31 is 20 Newton meters (Nm). A handwheel is connected radially to the plug-in part 32 that is suitable as a drive means for the first shaft for manually actuating same.

A receiving opening 32*a* is provided in the plug-in part 32 of the mechanical torque limiter 33 on the side facing away from the first shaft 21 whose dimensions are different from the above hexagonal sleeve part 21/shaft 21. An external drive means, such as a cordless screwdriver or the like, can be inserted into the receiving opening 32*a* in order to apply a motorized rotational force to the first shaft 21 instead of a manually applied rotational force. A hexagonal bolt 35 from the external drive means is shown schematically; it will readily be understood that it can be caused to rotate by a wide variety of different motorized drives.

If the torque applied manually or by motorized means to the torque limiter 33 lies below the threshold value of 20 Nm, the torque is transferred practically undiminished to the first shaft 31 and via the gear mechanism 23 to the second shaft 22, so that the force that is introduced brings about a rotation of the pulley 25 and, accordingly, a lifting or lowering of the pulling means 26 connected thereto, depending on the direction of rotation. If the torque that is introduced exceeds 20 Nm, a torque of no more than 20 Nm is transferred to the first shaft 21, whereas the slippage between the sleeve part 31 and the plug-in part 32 of the mechanical torque limiter 33 has the effect of limiting the torque.

The limitation of the torque set in this way prevents a positive-locking mechanism in the proximity of the ratchet 28 from being sheared off or the gear mechanism 23 from being damaged by the resulting forces in the event that rotation occurs inadvertently in the incorrect direction. In particular, the limitation of the torque 33 prevents the pulling means that is embodied as a rope 26 with a load attached thereto, particularly the load of a person to be rescued, from being exposed to excessive torque, which can result in severe injuries in the event of wedging or the like.

Figure 3:
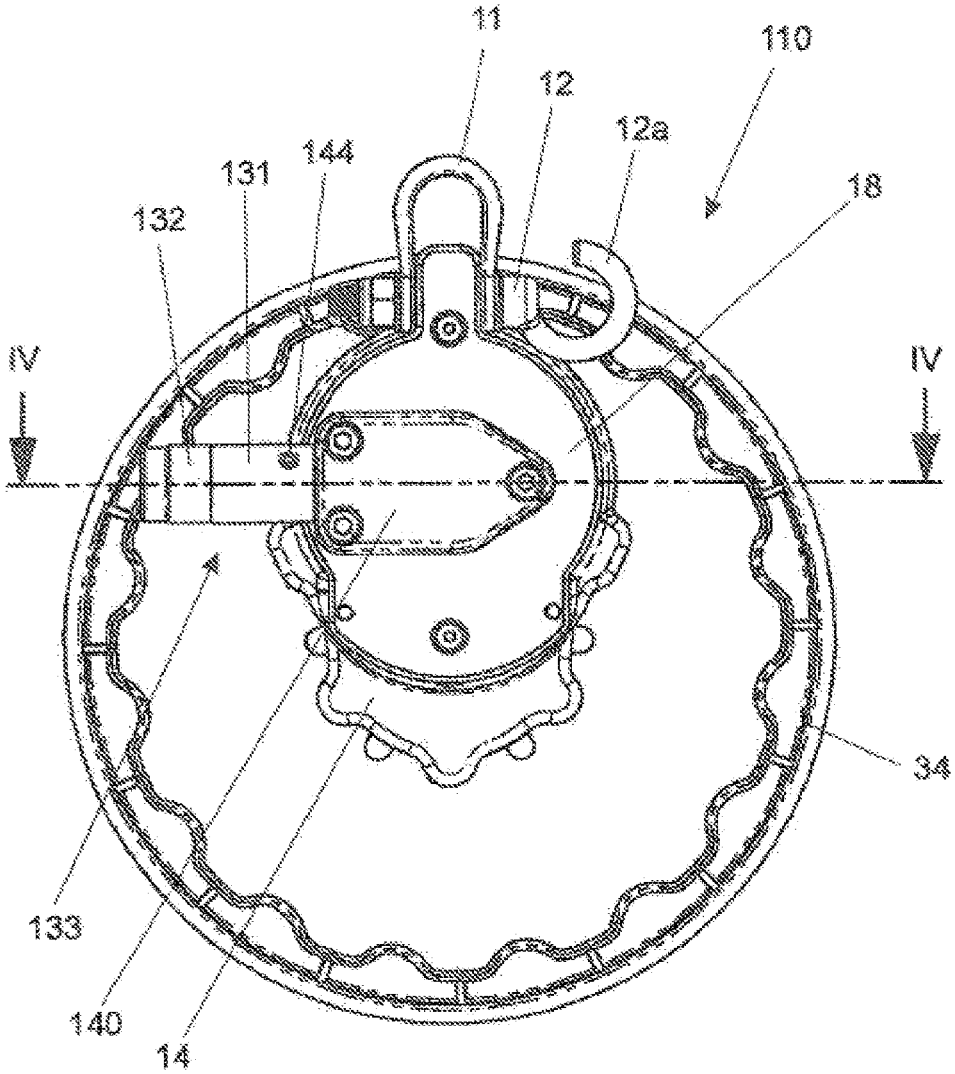
FIG. 3 shows a front-side view of another exemplary embodiment of an abseiling device 110 according to the invention.
Figure 4:
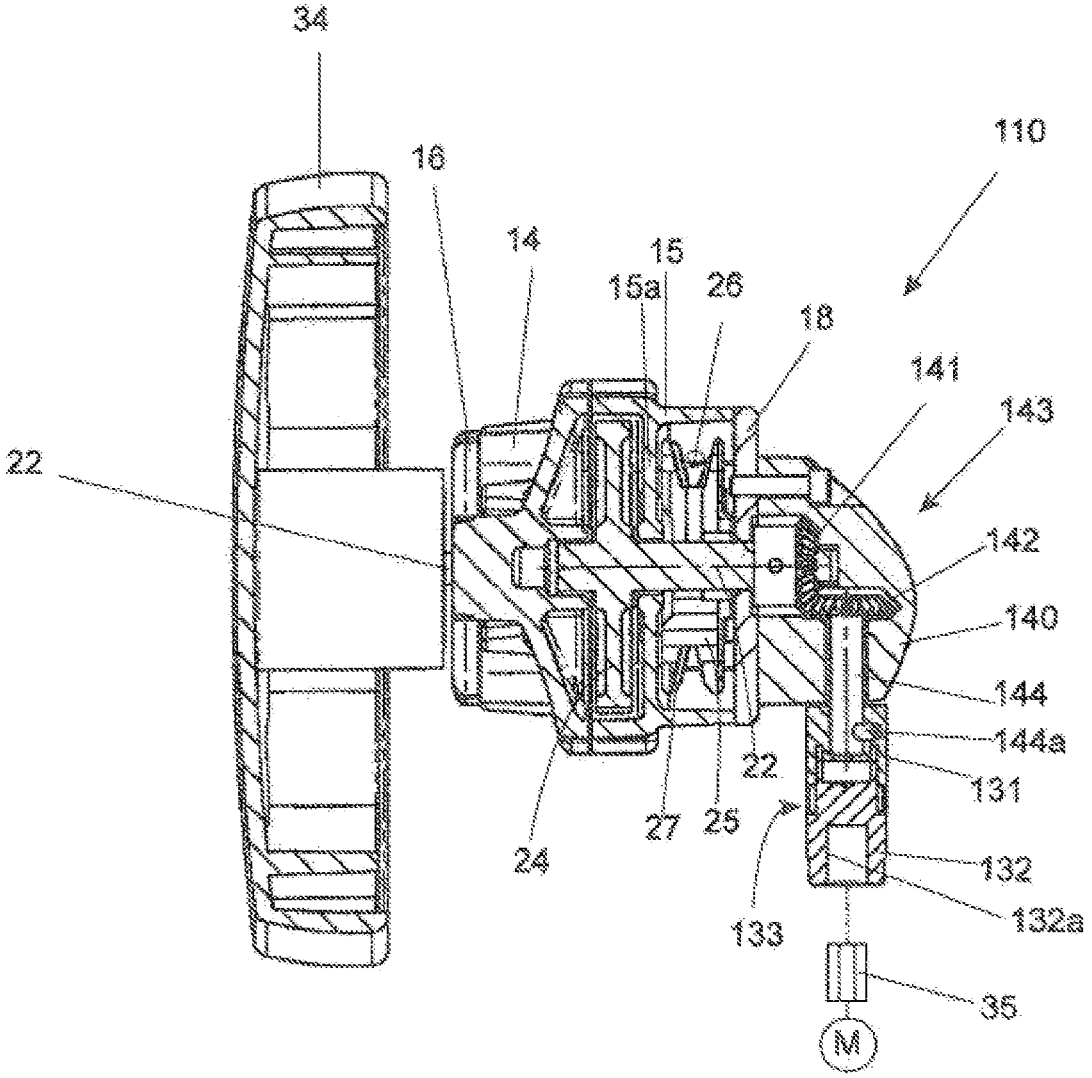
FIG. 4 shows a section along line IV-IV through the abseiling device from FIG. 3.

Fundamentally, the abseiling device 110 according to FIGS. 3 and 4 is constructed like the abseiling device 10 according to FIGS. 1 and 2, so the same or structurally comparable parts are designated by the same reference symbols, and parts that have been changed substantially are designated by reference symbols that have been incremented by 100 in comparison to the abseiling device 10.

The abseiling device 110 also has a housing 13 with two housing halves 14, 15, each of which is closed by a lid 16, 18, with a centrifugal brake 30 and peripheral toothing in the manner of a gear wheel 21*a* being provided on the first shaft 21, whereas a second shaft 22 carries the pulley 25 and a large gear wheel 24. One can also see a handwheel 34 that is connected to the first shaft 21, with the present embodiment of the handwheel 34 being connected to the first shaft 21 without a mechanical torque limiter 33. It will readily be understood that the handwheel 34 can also be connected with mechanical torque limiter 33 to the first shaft 21.

It can also be seen that the portion of the second shaft projecting over the pulley housing lid 18 projects into a bevel gear housing 140 and is embodied there in the manner of a bevel gear 141 that rotates together with the second shaft 22. A second bevel gear 142 that is arranged at a right angle to the bevel gear 141 on an axle 144 that is held in the bevel gear housing 140 engages with the bevel gear 141. The two bevel gears 141, 142 forms a bevel gear mechanism 143 which, in the present case, provides neither reduction nor transmission, since the diameters of the bevel gears match in the present exemplary embodiment. However, it is possible to provide a reduction or transmission ratio here.

The axle 144 protrudes on a horizontal plane out of the bevel gear housing 140 and is coupled with a sleeve part 131 of a mechanical torque limiter 133 by means of a radial pin 144*a*. A plug-in part 132 of a mechanical torque limiter 133 is plugged into the sleeve part 131; the end of the plug-in part 132 facing away from the axle 144 has a receiving portion or a tool bit 132*a* into which a rotating hexagonal bolt of a motorized external drive can be inserted, for example.

Moreover, the abseiling device 110 has a locking mechanism which, however, is connected to the first shaft 21 and blocks the gear mechanism 23 from the first shaft 21 and second shaft 22 as desired in one direction of rotation of the pulley 25 or in the other direction of rotation of the pulley 25 through positive engagement.

If a motorized tool is now inserted into the receptacle 132*a*, torques up to the threshold value of the mechanical torque limiter 133 are transferred to the bevel gear mechanism 143 and thus 1 to 1 to the second shaft 22. The corresponding torque is about 11 Nm in the present case.

Figure 5:
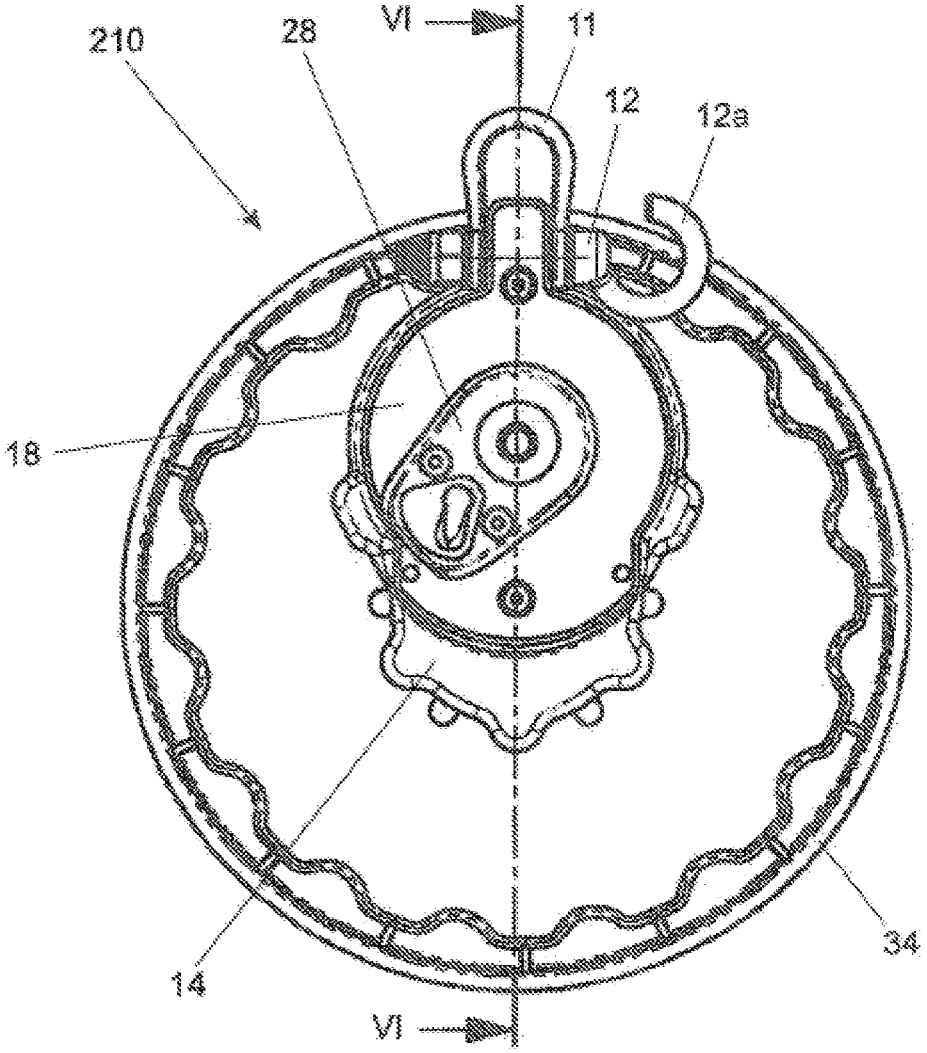
FIG. 5 shows a side view of another preferred exemplary embodiment of an abseiling device according to the invention.
Figure 6:
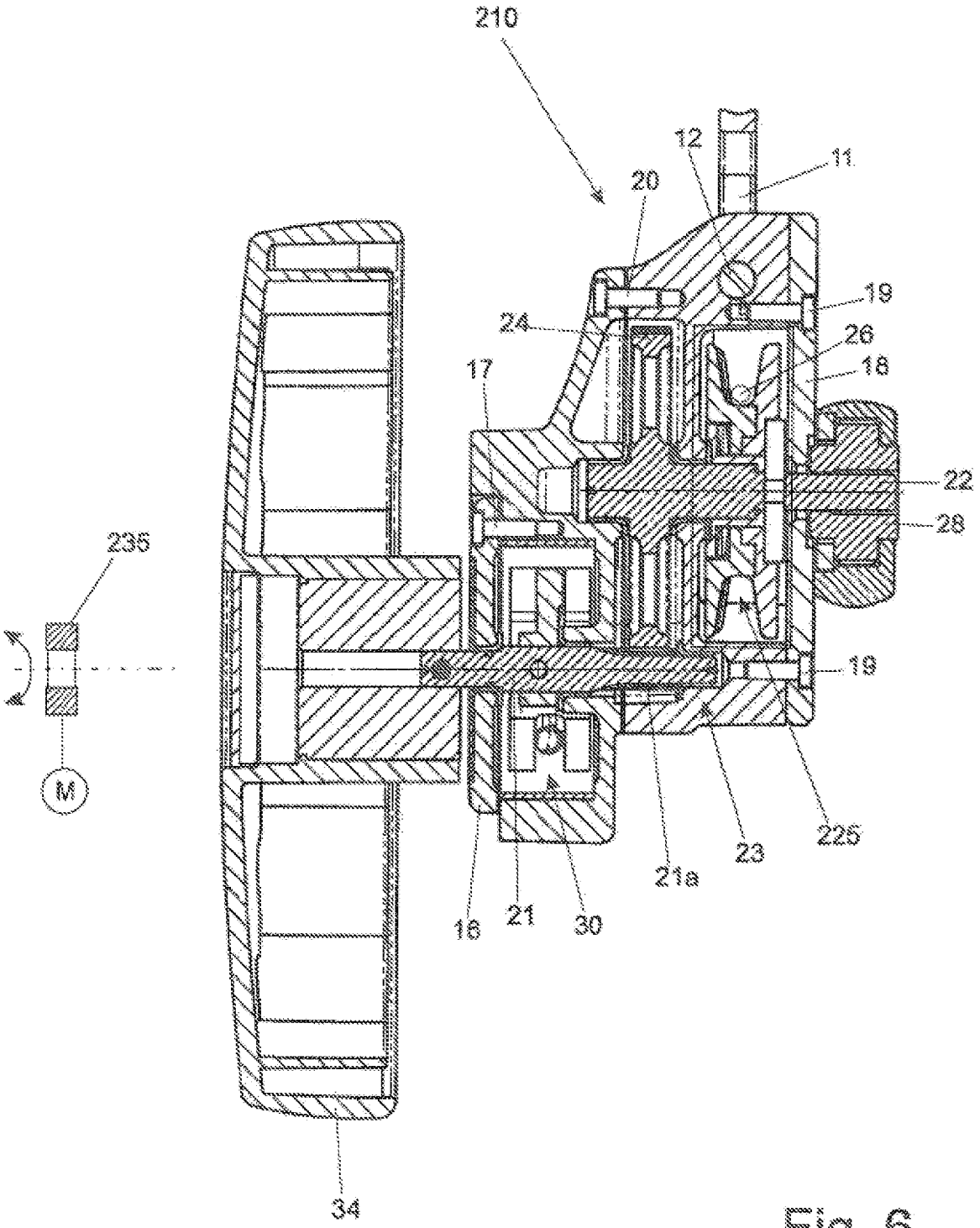
FIG. 6 shows a section along line VI-VI through the abseiling device from FIG. 5.
Figure 7:
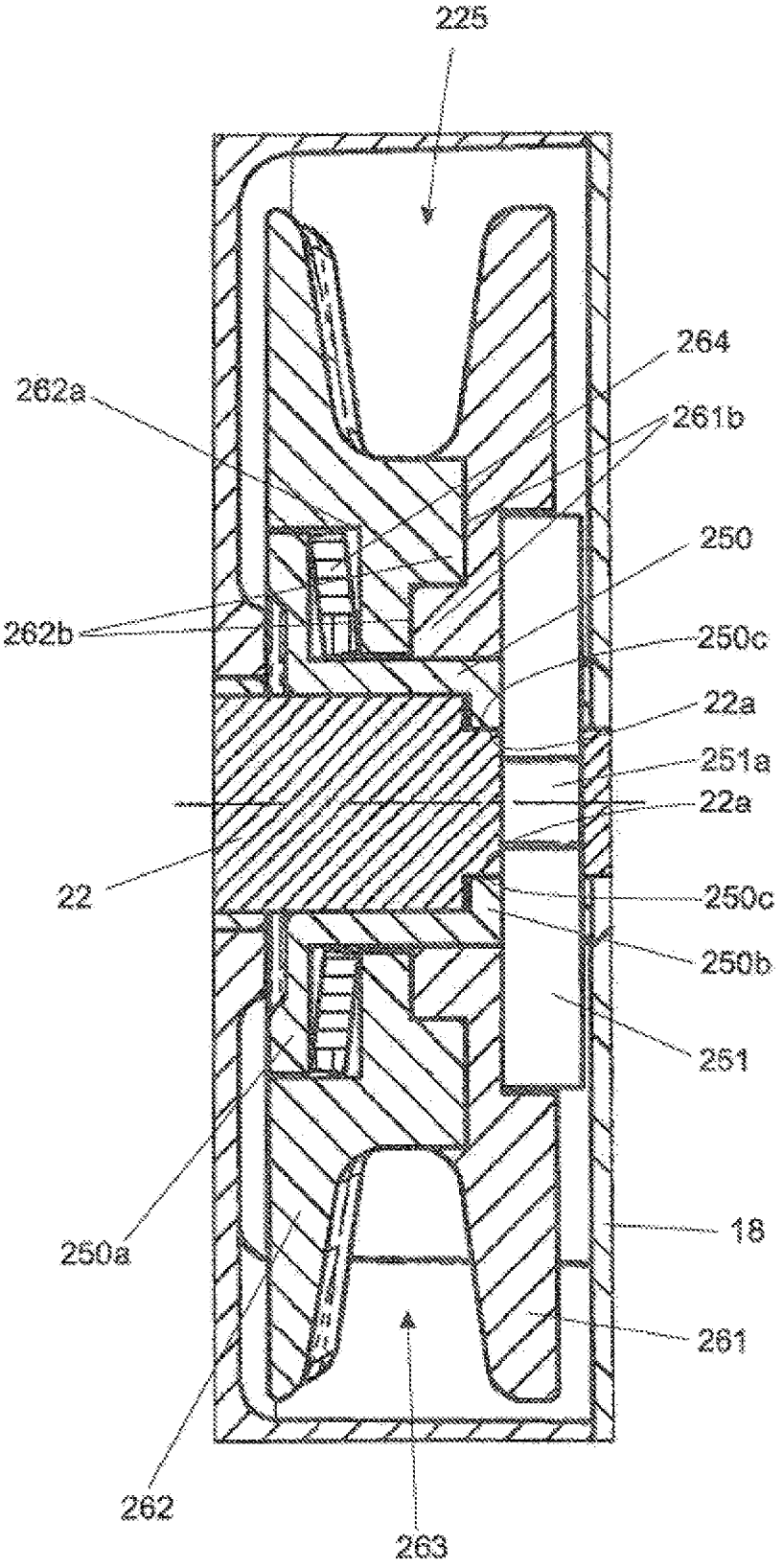
FIG. 7 shows an enlarged, cross-sectional view of the pulley of the abseiling device from FIG. 6.

FIGS. 5 to 7 show an abseiling device 210 that is modified in comparison to the abseiling device 10 from FIGS. 1 and 2 and in which the same reference symbols designate the same or structurally comparable parts as in the abseiling device 10. Altered parts are designated by reference symbols that have been incremented by 200 in relation to the abseiling device 10.

Again, the abseiling device 210 has a brake housing 14 and a pulley housing 15 as housing parts in a housing 13 that are interconnected and closed by brake housing lid 15 and pulley housing lid 18, respectively. A first shaft 21 is in geared engagement with a second shaft 22, with a centrifugal brake 30 being connected to the first shaft 21 and a pulley 25 being connected to the second shaft 22. The gear engagement is achieved by means of a peripherally toothed portion 21*a* of the first shaft 21 that is embodied in the manner of a gear wheel and a large gear wheel 24 that is arranged on the second shaft 22.

A handwheel 34 is connected to a portion of the first shaft 21 projecting over the brake housing lid 16 to which a portion of the second shaft 22 that projects over the pulley housing lid 18 a locking mechanism 28 is connected.

FIG. 7 shows greater detail of the pulley 225 that forms a mechanical torque limiter 263. The pulley 225 is embodied in two parts and has a first pulley half 261 disposed rotationally symmetrically about the axle of the second shaft 22 that engages together with a second pulley half 262, which is also rotationally symmetrical. The two pulley halves 261, 262 form the mechanical torque limiter 263.

The second shaft 22 passes through the pulley 225 and is accommodated circumferentially in a guide tube 250. On its end facing toward the ratchet 28, the guide tube 250 has an inwardly oriented end 250*b* that has a terminal outer toothing onto which a groove nut 251 is screwed. In the vicinity of the outer toothing and a bit beyond it, designed as 250*c* in FIG. 7, the end 250*b* has two inwardly protruding flattened regions that fit together with flattened portions 22*a* recessed appropriately from the cylindrical structure of the second shaft 22 and thus ensure a positive-locking entrainment of the guide tube 250 with the second shaft 22. The two pulley halves 261, 262 are coupled with the rotational movement of the second shaft 22 and of the guide tube 250 on which both are arranged.

The groove nut 251 has four grooves 251*a*, each of which is offset by 90°, and is arranged in a rear-side recess of the first pulley half 261. The end of the guide tube 250 facing away from the groove nut 251 is embodied as an outwardly expanded flange 250*a* that has a square basic shape that cannot be seen clearly in FIG. 7. The square flange 250*a* fits in a positive-locking manner into a corresponding square recess 262*a* of the second pulley half 262 and thus carries the second pulley half 262 along as it rotates.

A disc spring 264 is arranged between the flanged portion 250*a* and a base of the recess 262*a* in the pulley half 262. The disc spring 264 biases the second pulley half 262 toward the first pulley half 261 and presses the two pulley halves 261, 262 together, so that when small torques occur under the pretension of the disc spring 264, they rotate at the same rotational speed. In order to achieve mutual coupling and entrainment in the direction of rotation, the two pulley halves 261, 262 have positively locking, outwardly or inwardly projecting, mutually facing regions 261*b*, 262*b* that are complementary, so that an outward projection of the region 261*b* engages in an inward projection of the region 262*b* and/or vice versa, thus ensuring the simultaneous rotation of the two pulley halves 261, 262 at the same speed. The outward projects and inward projections are expediently dimensioned so as to be larger than the maximum spring deflection of the disc spring 264. Due to the fact that at least the second pulley half 262 is not coupled with the guide tube 250 in the axial direction (direction of the axis of rotation of the second shaft 22), at least the second pulley half 262 can be moved away from the first pulley half 261 counter to the pretension of the disc spring 264. However, the pulley halves 261, 262 remain engaged with one another through the region 261*b*, 262*b*.

If the torque introduced into the second shaft 22 is exceeded, the second pulley half 262 is displaced counter to the pretension of the disc spring 264 from the first pulley half 261 toward the flanged portion 250*a*, and the approximately U- or V-shaped profile 227 of the disc spring 225 enlarges, so that the slippage of a guided pulling means 26, particularly one that is embodied as a rope, increases with an approximately circular diameter. A mechanical limitation of torque is thus achieved by the described configuration of the pulley 225 by virtue of the fact only a defined maximum torque is transferred to the rope 26. What is key for the slippage of the rope 26 in relation to the pulley 225 is the broadened profile 227, which holds the rope 26 in a less clamping manner and thus prevents the transmission of the torque beyond the set threshold value.

The pulley 225 also has radial projections and recesses on the mutually facing portions of the pulley halves 261, 262 guiding the rope 26, which prevent the rope 26 from slipping through. If a torque is now applied to the pulley that is greater than the set threshold value, this has the effect that the rope 26 moves radially closer to the axis of rotation of the second shaft 22. Through the thickness of the rope 26, the second pulley half 262 is then displaced axially against the pretension of the spring 264, whereby the slippage increases again for the rope, so that the torque is not transferred completely to the rope 26. For this purpose, the springs 264, the material, and the dimensions of the rope 26 as well as the profiling of the pulley 225 are coordinated carefully with one another so that the threshold value of the transmitted torque is set in a suitable range.

After the handwheel 34 is removed, a motor-driven, schematically illustrated nut 235 can be placed onto the first shaft 21 in order to drive the pulley 225.

It will be readily understood that it is likewise possible to decouple a pulley from the second shaft 22 by arranging a mechanical torque limiter such as the torque limiter 33 shown in FIG. 2 to a sleeve part 31 in a plug-in part 32 in extension of the shaft 22, with the sleeve part being coupled radially with the pulley.

Fundamentally, the abseiling device 310 according to FIGS. 8 to 11 is constructed like the abseiling device 10 according to FIGS. 1 and 2, so the same or structurally comparable parts are designated by the same reference symbols, and parts that have been changed substantially are designated by reference symbols that have been incremented by 300 in comparison to the abseiling device 10.

The abseiling device 310 also has a housing 13 with two housing halves 14, 15, each of which is closed by a lid 16, 18, with a centrifugal brake 30 and peripheral toothing in the manner of a gear wheel 21*a* being provided on a first shaft 21, whereas a second shaft 22 carries the pulley 25 and a large gear wheel 24. Furthermore, a handwheel 34 is visible that is connected to the first shaft 21, with a mechanical torque limiter 33 being integrated with a sleeve part 31 and a plug-in part 32 into the handwheel 34. Particularly in the sectional representation according to FIG. 11, one can see the first shaft 21, the second shaft 22, the gear mechanism 23, the gear wheels 21*a* and 24, and the pulley 25, which guides the pulling means that are embodied as a rope 26.

Figure 8:
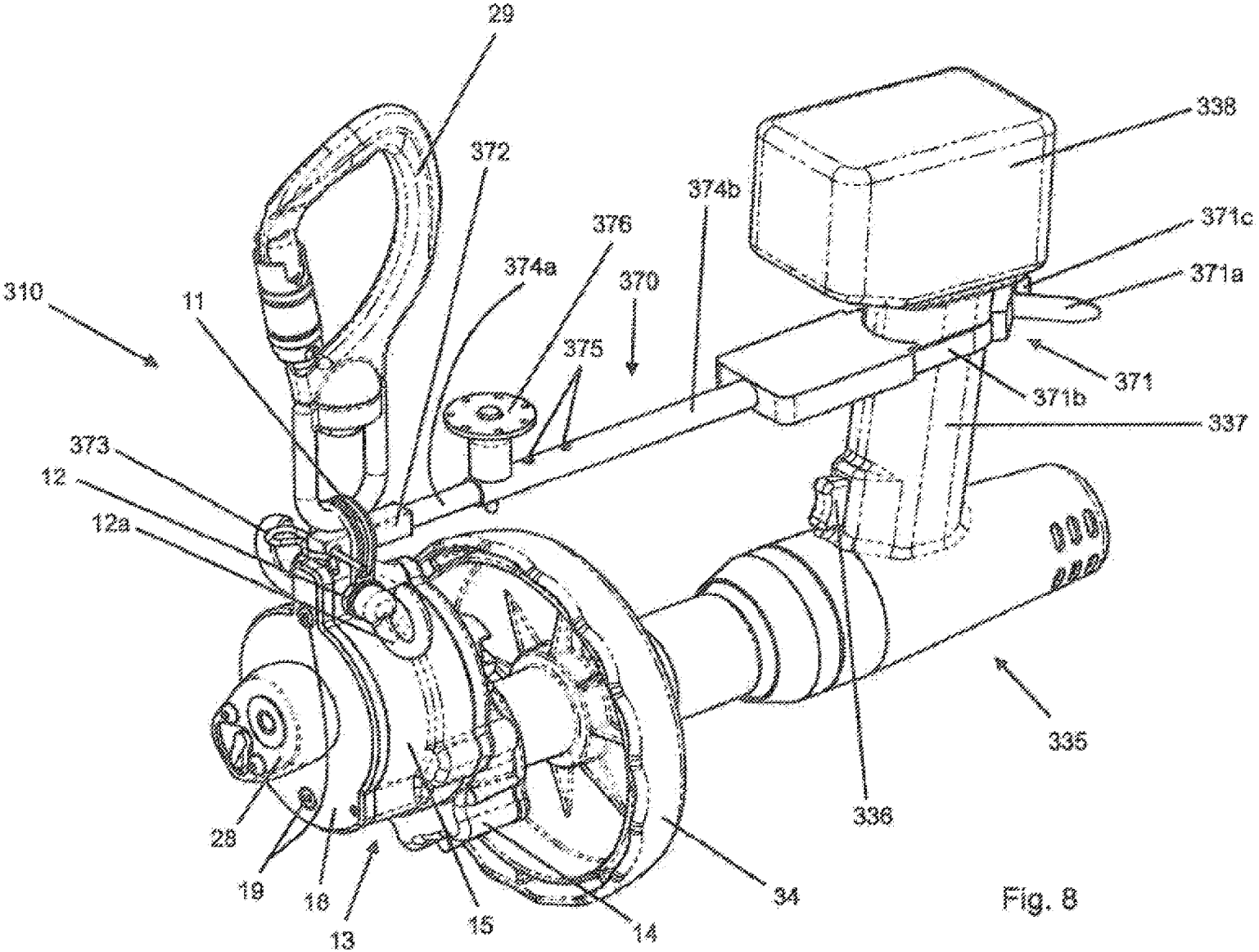
FIG. 8 shows a perspective view of another exemplary embodiment of an abseiling device according to the invention.
Figure 9:
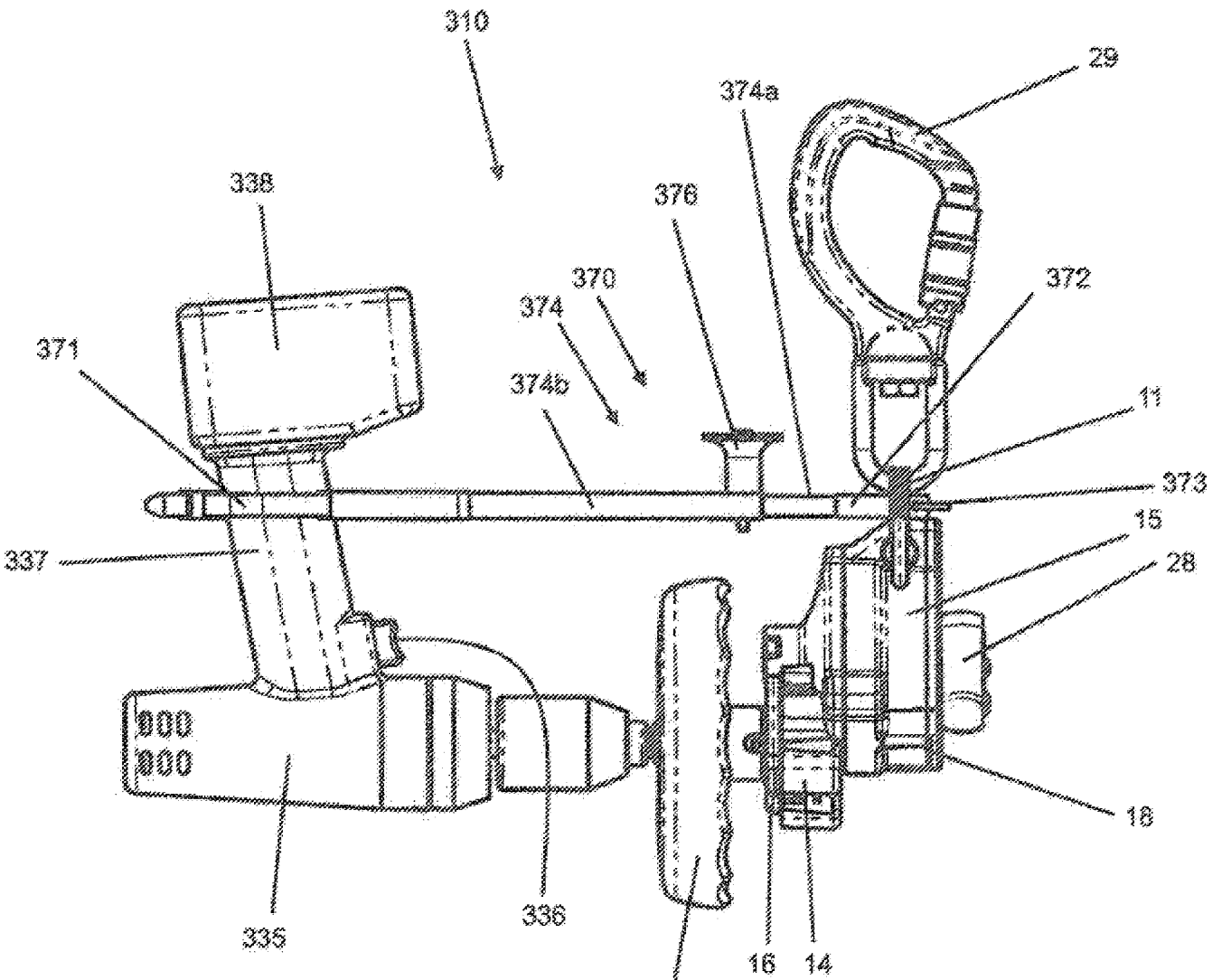
FIG. 9 shows a side view of the abseiling device from FIG. 8.
Figure 10:
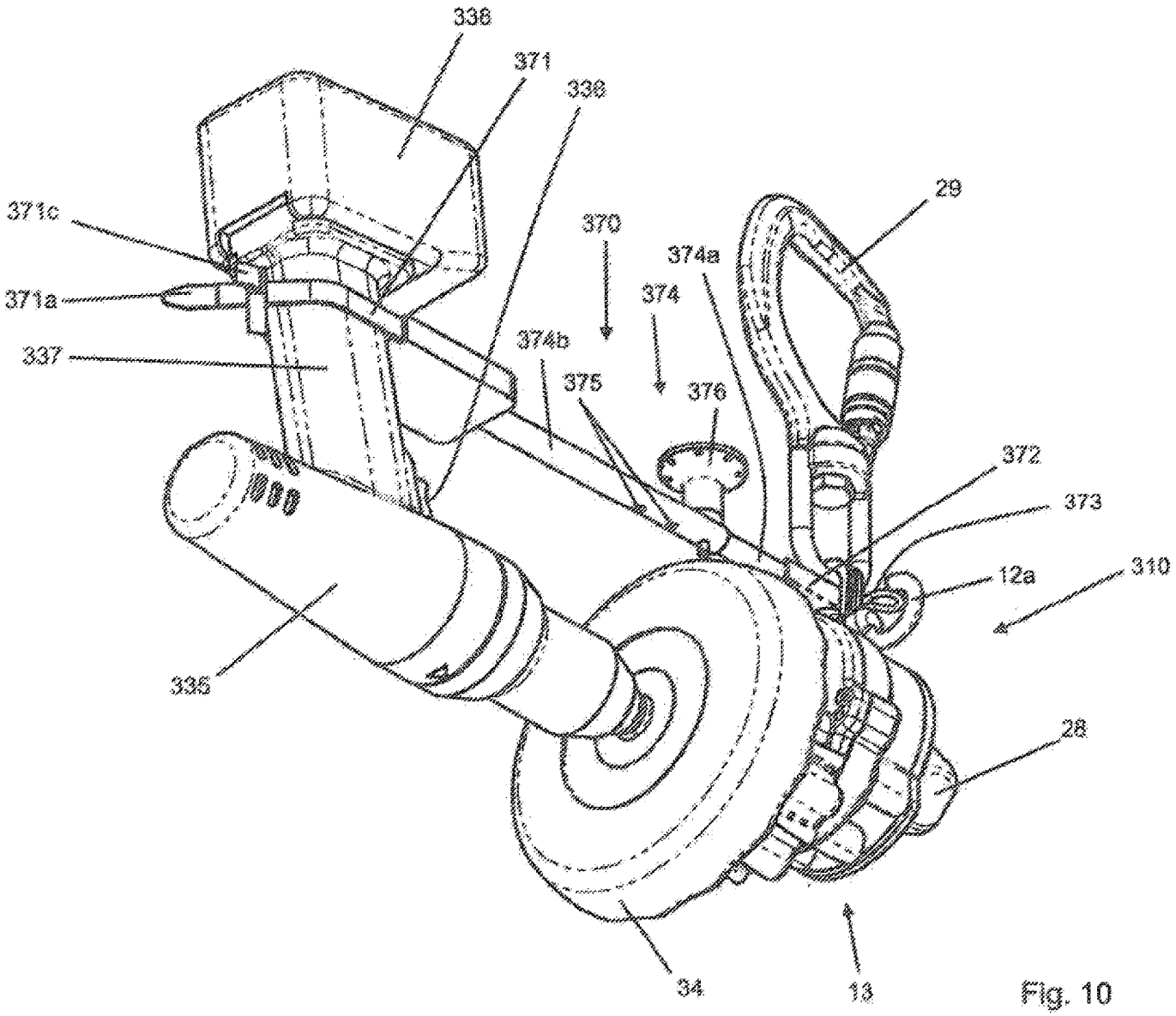
FIG. 10 shows a perspective view of the abseiling device from FIGS. 8 and 9 from another viewing angle.
Figure 11:
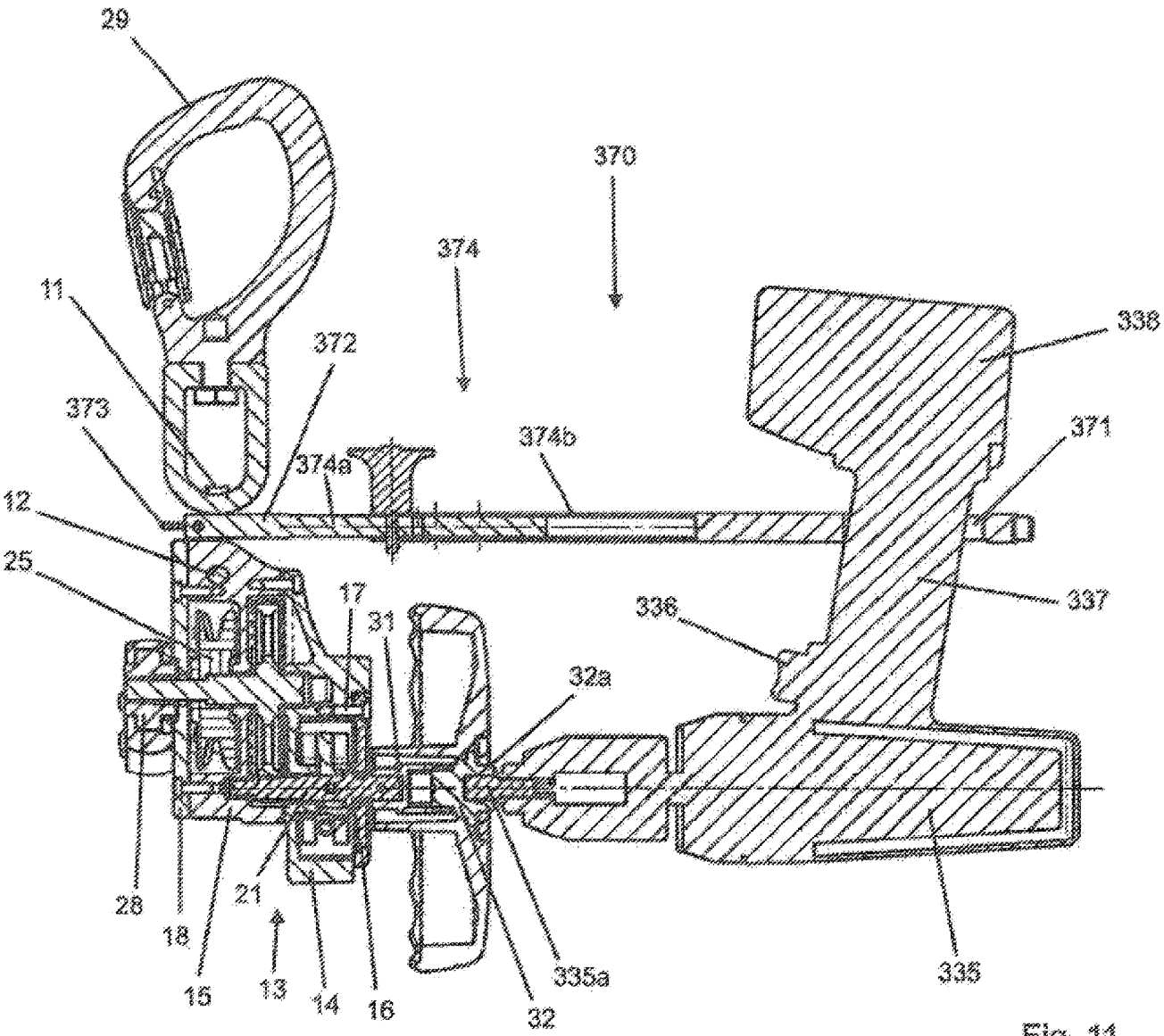
FIG. 11 shows a cross section through the abseiling device from FIGS. 8 to 10.

It can be seen in FIG. 8 that a drive means 335 that is embodied as a cordless screwdriver is inserted with a drive shaft 335*a* that is embodied as a hexagonal bolt into a receiving opening 32*a* of the plug-in part 32 of a mechanical torque limiter 33, which plug-in part 32 constitutes a torque-limiting means with the sleeve part 31. The plug-in part 31 and the sleeve part 32 are integrated into the handwheel 34, with the mechanical torque limiter 33 not transferring a torque to the first shaft 21 that exceeds 20 Nm.

It can be seen that a control button 336 of the drive means 335 can be operated in the manner of a pistol trigger. Furthermore, it can be seen that a grip 337 of the drive means 335 projects substantially perpendicular to the axis of the drive shaft that is embodied as a hexagonal bolt 335*a*, with a power supply that is embodied as a rechargeable battery being inserted into and removed from the grip 337 in the bottom region of the grip (here always shown at the top).

The grip 337 of the drive means 335 is connected to the housing 13 of the abseiling device 310 by means of a holding fixture 370. To connect the grip 337, the holding fixture 370 has a multiply openable and closable ring 371 that is embodied in the manner of a reclosable cable clip and the length of which is adapted to the circumference of the grip 337. This ring 371, which can enclose different-sized grips 337 and lock them in place with the holding fixture 370, makes it possible to accommodate grips of different drive means, so that drive means from various manufacturers can be connected to the abseiling device 310. For this purpose, a first belt 371*a* is passed with a pointed end and with a ribbing provided on the wide surface through a second belt 371*b*, which is equipped with a locking mechanism that can be actuated using a lever 371*c*, and fixed through the actuation of the lever 371*c*.

The end of the holding fixture 370 facing away from the ring 371 is embodied as a quadrilateral profile 372 and forms a coupling portion that is passed through a holding component of the abseiling device 310 embodied as a clevis or carabiner 11 and abuts against the upwardly oriented projection of the pulley housing lid 18. A borehole 372*b* of the quadrilateral profile 372 is passed through by a safety pin 373, which locks the quadrilateral profile 372 against the carabiner 11. This limits the axial mobility of the holding fixture 370. It can be seen that the underside of an additional, large carabiner 29 also passes through the carabiner 11. The projection of the pulley housing lid 18 and carabiner 11 thus each form a holding component of the abseiling device to which the coupling portion 372 of the holding fixture 370 can be fixed.

A middle region 374 is provided between the quadrilateral profile 372 and the ring 371 that consists of two cylindrical, telescopic sections 374*a*, 374*b*, with at least the cylindrical section 374*b* being hollow. It can be seen that punched holes 375 are provided radially to the axis of the two cylindrical sections 374*a*, 374*b*, one of which is passed through by a locking pin 376. The locking pin 376 passes through both the inner cylindrical section 374*a* and the outer cylindrical section 374*b* and connects them by means of aligned pairs of holes. It will readily be understood that the locking pin 376 is coupled by means of an appropriate connection to the holding fixture 370 in order to prevent it from falling. The length of the holding fixture 370 is then adjusted by having the locking pin 376 pass through two aligned radial boreholes 375 of the inner cylindrical section 374*a* and of the outer cylindrical section 374*b*. The locking pin 376 passing through the boreholes 375 is dimensioned appropriately such that a substantially backlash-free connection of the two sections 374*a*, 374*b* is achieved.

It can be seen that the holding fixture 370 is fixed to the holding component—together with the housing 13 with the pulley housing lid 18 and the carabiner 11 in the present exemplary embodiment—so that the holding fixture 370 practically does not move in relation to the housing 13. It can also be seen that the drive means 335 is held securely in the ring 371, so that the axis of the drive shaft 335*a* of the drive means 335 that is embodied as a hexagonal bolt aligns with the receptacle 32*a* of the plug-in part 32, so that the drive shaft 335*a* is inserted into the receptacle 32*a*. The abseiling device 310 with the holding fixture 370 and the drive means 335 thus forms a stable structural unit that makes it possible to operate the motorized drive means 335 with its control button 336 practically with one finger. The holding fixture 370 absorbs the countermovement to the rotational movement of the drive shaft 335*a*, so that this rotary force is not transferred to the hand of an operator.

It will readily be understood that it is possible to connect additional parts of the drive means 335—those to which no rotational movement is to be imparted, for example—to the holding fixture 370. For instance, an arm reaching vertically down from the middle section 374 could constitute an additional ring with which a region of the drive means 335 is grasped near the control button 336. Furthermore, it is also possible to connect the holding fixture 370 to other parts or interlinks that are provided between drive means and the first shaft 21.

Figure 12:
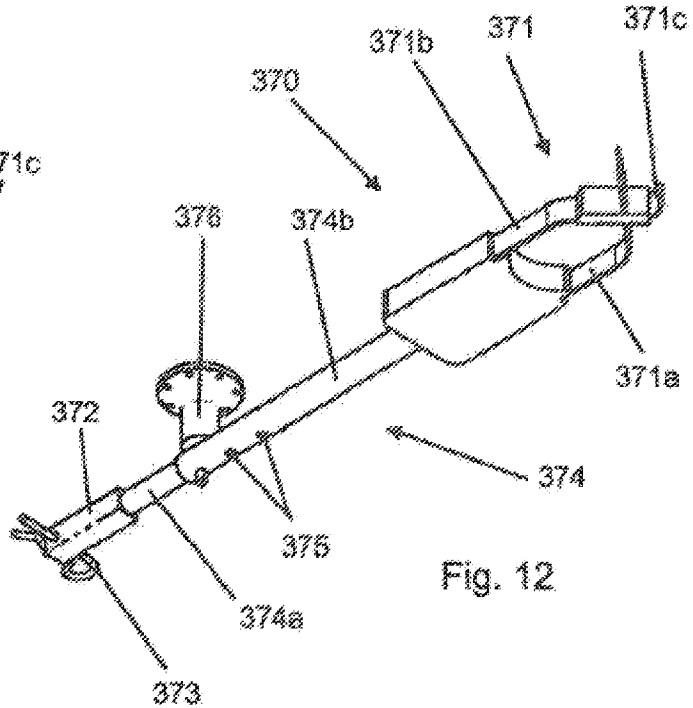
FIG. 12 shows a perspective view of the holding fixture of the abseiling device from FIGS. 8 to 11.
Figure 13:
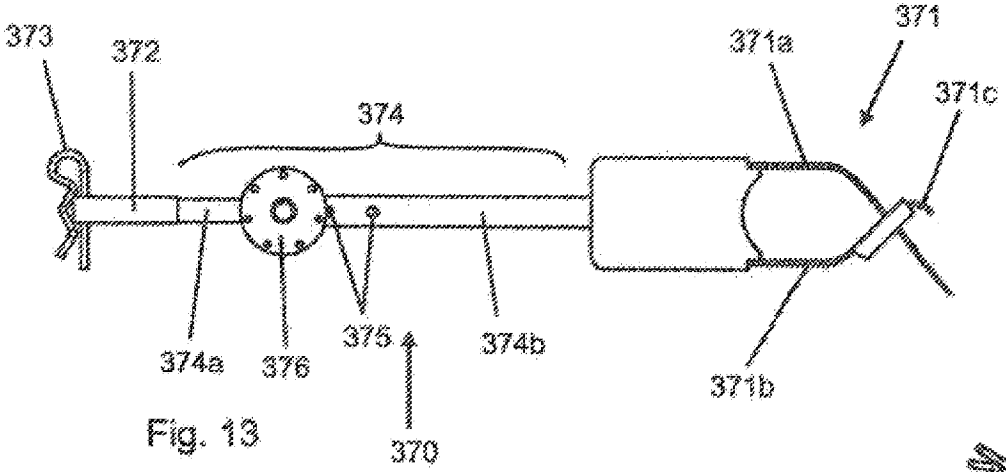
FIG. 13 shows the holding fixture from FIG. 12 as viewed from above.

FIGS. 12 and 13 show the holding fixture 370 detached from the abseiling device 310. It can be seen that the holding fixture can be modified in various respects. For example, instead of a holding fixture with a substantially central axis, a holding fixture with two lateral axes can also be provided.

The invention was explained above with reference to an exemplary embodiment in which the motorized drive means 335 begins with its drive shaft 335*a* substantially in axial extension of the first shaft 21. It will readily be understood that, depending on the design of the input of the shaft of the abseiling device, the motorized drive means can also be arranged in other positions. One especially favorable arrangement, for example, is achieved if the motorized drive means can be arranged parallel to a plane of the lid 16, 18, since the holding fixture, which prevents the motorized drive means from rotating, can then be quite compact, for example as a clip or ring connected to the housing 13 that engages around the motorized drive means.

The invention was explained above with reference to an exemplary embodiment in which the receptacle 32*a* into which the drive shaft 335*a* is inserted is provided on an outwardly facing front side of the handwheel 34. It will readily be understood that the receptacle 32*a* can also be provided on a front side of the housing if the abseiling device has no handwheel. Furthermore, to facilitate the insertion of the drive shaft 335*a*, an inlet cone can be embodied at the receptacle 32*a*.

The invention was explained above with reference to an exemplary embodiment in which the holding fixture 370 is detachably connected to the holding component. It will readily be understood that the holding fixture can also be connected in a non-detachable manner to or be integrally formed with the holding component, an attaching part, or the housing 13.

The invention was explained above with reference to exemplary embodiments in which the braking device that is embodied as a centrifugal brake 30 and the guiding arrangement that is embodied as a pulley 25 are arranged on two different shafts 21, 22. It will readily be understood that a braking device or centrifugal brake and a guiding arrangement or pulley can also be arranged on a common shaft, in which case the drive means, handwheel 34, or external motorized drive means can then be attached to the same shaft or to an axle that is coupled by means of a gear mechanism. If the centrifugal brake is located on the same shaft as the pulley, the mechanical torque limiter can be arranged either in the proximity of the attachment for the drive means or between shaft and pulley and/or rope.

The invention was explained above with reference to exemplary embodiments in which a mechanical torque limiter is respectively arranged between the motorized external drive means and the pulley 25, 225 that transfers a torque to the pulley via a gear mechanism 143. It will readily be understood that a gear mechanism need not necessarily be provided between the pulley and the mechanical torque limiter, or that the gear mechanism can also have a design that is different from the one described, for example as a planetary gear, hydraulic gear, link mechanism, or the like.

The invention was explained above with reference to exemplary embodiments in which the mechanical torque limiter 33, 133 has a sleeve part 31, 131 and a plug-in part 32, 132, with the motorized drive means being insertable into a receptacle 32*a* of the plug-in part. It will readily be understood that the order of the sleeve part and plug-in part can also be reversed, or that torque limiters having completely different designs can also be used. In particular, besides mechanical torque limiters, electromechanical torque limiters can also be used in which a sensor detects the torque and appropriately throttles the transmission of the torque.

The invention was explained above with reference to exemplary embodiments in which both a handwheel 34 and an external motorized drive means 35, 235, 335 are worthy of consideration. It will readily be understood that, instead of the handwheel, a motorized drive means can also be securely coupled with the abseiling device 10, 110, 210 that can be operated by means of an internal or an external power supply, for example. Furthermore, it will be readily understood that the handwheel 34 and the locking mechanism 28 need not necessarily be arranged on different shafts, but rather can also engage on the same shaft, and that it can be left open on which of the two shafts 21, 22 the locking mechanism 28 or the handwheel engages.

The invention was explained above with reference to exemplary embodiments in which the external drive means is attached substantially on a horizontal axis. It will readily be understood that it is also possible to provide the coupling with the pulley such that the drive means can also be attached on a vertical axis or on a skew axis that more easily accessible for an operator.

The invention was explained above with reference to exemplary embodiments in which the pulling means that is embodied as a rope 26 is decoupled from the drive. This is the case even when no rope is placed in the abseiling device.

The invention was explained above with reference to exemplary embodiments in which the mechanical torque limiter is provided outside of the gear connection 23, 143. It will readily be understood that the mechanical torque limiter can also be provided between a shaft and a gear wheel arranged on the shaft. In particular, either the plug-in part or sleeve part can be embodied with peripheral toothing.

The invention was explained above with reference to an exemplary embodiment in which the motorized drive means is provided outside of the housing of the abseiling device 10, 110, 210. It will readily be understood that the motorized drive means can also be provided within the housing or in another housing part that is connected to the housing in order to form a compact structural unit. In this case, the drive can also be designed to be switchable in terms of its direction of rotation; particularly, the switching of the drive can be coupled with the catches of the locking mechanism or ratchet 28 in order to ensure that the pulley is rotated each time in the correct direction.

The invention was explained above with reference to exemplary embodiments in which the mechanical torque limiter has a fixed threshold value for torque transmission and does not transfer torques that exceed the threshold value. It will readily be understood that the abseiling device can also have several torque limiters, or that the threshold value of the torque limiter can also be adjustable.

The invention was explained above with reference to exemplary embodiments in which the guiding arrangement is embodied as a pulley 25, 225 that is embodied so as to have a circumferential, V-shaped recess. It will readily be understood that other guide rollers, or pulleys having different contours, including guide rollers with a cylindrical or conical profile, can also be used to guide a rope 26.

The invention was explained above with reference to exemplary embodiments in which the braking device is embodied as a centrifugal brake 30. It will readily be understood that the braking device can also be implemented using other types of brake.

The invention was explained above with reference to exemplary embodiments in which the abseiling devices with a descending function can lift a load with limited torque. It will readily be understood that these abseiling devices can also be used only for lifting, particularly as a rescue lifting device, in which case the braking device can be disabled or omitted.

The invention was explained above with reference to exemplary embodiments in which the mechanical torque limiters 33, 133, 263 are arranged in different places between drive means and pulling means 26 or guiding arrangement 25, 225. It will readily be understood that the mechanical torque limiter is especially preferably provided outside of the gear connection 23 of guiding arrangement 25, 225 and braking device 30 in order to not impair the descending and braking function during rappelling.

The invention was explained above on the basis of abseiling devices 10, 110, 201, which are also lifting devices at the same time. It will readily be understood that, when the assemblies specific to the abseiling device are omitted, one obtains a lifting device according to the invention or, otherwise, a combined abseiling and lifting device.

We claim:

1. An abseiling device, comprising a bidirectionally rotatable guiding arrangement for guiding a pulling means; and a braking device that is coupled to the guiding arrangement, wherein the braking device is embodied as a centrifugal brake, wherein a drive apparatus can be connected to the guiding arrangement for actuating the guiding arrangement, wherein a mechanical torque limiter decouples the drive apparatus and one of the guiding arrangement and the pulling means when a torque threshold value is exceeded.

2. The abseiling device as claimed in claim 1, wherein the mechanical torque limiter is arranged between the drive apparatus and the guiding arrangement.

3. The abseiling device set as claimed in claim 1, wherein the mechanical torque limiter is part of a device for manually actuating the abseiling device coupled to the guiding arrangement.

4. The abseiling device as claimed in claim 1, wherein the braking device is coupled to a first shaft, and wherein the mechanical torque limiter is arranged on the first shaft.

5. The abseiling device as claimed in claim 1, wherein the guiding arrangement is coupled to a second shaft, and wherein the mechanical torque limiter is arranged on the second shaft.

6. The abseiling device as claimed in claim 1, further comprising a gear mechanism including a first shaft and a second shaft rotatably coupled to each other in a torque-proof manner, wherein one of the first shaft and the second shaft is positively lockable in one direction of rotation by a locking mechanism and is released in the opposite direction of rotation, and wherein the positive locking can be switched to both directions of rotation.

7. The abseiling device as claimed in claim 1, wherein the guiding arrangement is coupled with the braking device by means of a gear mechanism.

8. The abseiling device as claimed in claim 7, wherein the gear mechanism comprises a first shaft on which the braking device is arranged, and comprises a second shaft on which the guiding arrangement is arranged.

9. The abseiling device as claimed in claim 7, wherein a first gear wheel of the gear mechanism is supported on a common first shaft with the braking device, wherein a second gear wheel of the gear mechanism is supported in a torque-proof manner on a common second shaft with the guiding arrangement, wherein the first gear wheel engages with the second gear wheel, and wherein the first gear wheel is embodied as a small gear wheel and the second shaft is embodied as a large gear wheel.

10. The abseiling device as claimed in claim 1, wherein the mechanical torque limiter comprises a plug-in part and a sleeve that are inserted into one another and that mutually generate slippage when a threshold torque value is exceeded.

11. The abseiling device as claimed in claim 1, wherein the mechanical torque limiter comprises two halves of the guiding arrangement that conjointly guide the pulling means and, when the torque threshold value is exceeded, permit one of mutual slippage and slippage of the pulling means in relation to the guiding arrangement.

12. The abseiling device as claimed in claim 1, wherein the drive apparatus is a motorized drive selected from a group comprising an impact wrench, a pneumatic drilling apparatus, a hydraulic turbine, a combustion engine, and a cordless screwdriver.

13. The abseiling device as claimed in claim 1, wherein the guiding arrangement is embodied as a rotatably mounted guide roller, wherein the guide roller is bidirectionally rotatable, wherein the pulling means is embodied as a rope, and wherein the rope is placed and deflected by about 180° around the guiding arrangement.

14. The abseiling device as claimed in claim 1, wherein the drive apparatus can be accommodated in a holding fixture, and wherein the holding fixture can be fixed to a holding component of the abseiling device.

15. The abseiling device as claimed in claim 14, wherein the holding fixture has a receptacle for a grip of the drive apparatus that can be locked in order to fix the drive apparatus in place, wherein the holding fixture can be fixed in a torque-proof manner to the holding component, wherein the holding fixture has a portion whose length can be adjusted, and wherein the holding fixture is arranged parallel to an axle of the guiding arrangement.

16. The abseiling device as claimed in claim 14, wherein the holding fixture supports interlinks arranged between an output shaft and an input shaft of the abseiling device, and wherein the holding component is selected from the group comprising a housing of the abseiling device, a housing part of the abseiling device, a ring, a carabiner, a clevis, an eye connected to the abseiling device, and a chuck provided on the abseiling device.

17. An abseiling device for personal rescue, comprising a bidirectionally rotatable guide roller for guiding a rope, an input shaft having a drive end for coupling an external motorized drive apparatus, a braking device, and a mechanical torque limiter, wherein the input shaft is rotatably coupled to the guide roller, wherein the braking device is rotatably coupled to the guide roller, wherein the mechanical torque limiter decouples the drive end and the guide roller when a torque exceeding a torque threshold value is applied by the external drive apparatus such that a person can be lifted without risk of personal injury.

18. The abseiling device as claimed in claim 17, wherein the rope is held by the guide roller in a slip-proof way, wherein the rope has two ends and is placed and deflected by about 180° around the guide roller such that each of the two ends of the rope can be used for abseiling persons alternately, wherein the braking device comprise a centrifugal brake, and wherein the guide roller is coupled to the braking device by means of a gear mechanism having a first gear wheel arranged together with the braking device on a first shaft and a second gear wheel arranged together with the guide roller on a second shaft.

19. The abseiling device as claimed in claim 17, wherein the mechanical torque limiter comprises a plug-in part and a sleeve that are inserted into one another and that mutually generate slippage when the torque applied to the input end exceeds the threshold value, wherein the plug-in part and the sleeve are coaxially arranged on a common axis.

20. A device for abseiling and lifting a load, comprising a bidirectionally rotatable guiding arrangement for guiding a pulling means; and a braking device that is coupled with the guiding arrangement, wherein a drive apparatus can be connected to the guiding arrangement for actuating the guiding arrangement, and a mechanical torque limiter, wherein the mechanical torque limiter comprises a plug-in part and a sleeve that are inserted into one another and that mutually generate slippage, and wherein the mechanical torque limiter decouples the drive apparatus and one of the guiding arrangement and the pulling means when a torque threshold value is exceeded.

21. An abseiling device, comprising a bidirectionally rotatable guiding arrangement for guiding a pulling means; and a braking device that is coupled to the guiding arrangement, wherein a drive apparatus can be connected to the guiding arrangement for actuating the guiding arrangement, wherein the drive apparatus can be accommodated in a holding fixture, wherein the holding fixture can be fixed to a holding component of the abseiling device, wherein the holding fixture has a portion whose length can be adjusted, wherein the holding fixture has a ring enclosing a grip of the drive apparatus in order to fix the holding fixture relative to the grip, wherein the holding fixture can be fixed in a torque-proof manner to the holding component, and wherein the holding fixture is arranged parallel to an axle of the guiding arrangement.

* * * * *